US005712070A

United States Patent [19]

Nozawa et al.

[11] Patent Number: 5,712,070

[45] Date of Patent: Jan. 27, 1998

[54] TONER FOR DEVELOPING ELECTROSTATIC IMAGE, IMAGE FORMING METHOD, DEVELOPING DEVICE AND PROCESS CARTRIDGE

[75] Inventors: Keita Nozawa, Yokohama; Motoo Urawa, Funabashi; Osamu Tamura, Kawasaki; Tsutomu Kukimoto, Yokohama, all of Japan

[73] Assignee: Canon Kabushiki Kaisha, Tokyo, Japan

[21] Appl. No.: 597,876

[22] Filed: Feb. 7, 1996

[30] Foreign Application Priority Data

Feb. 10, 1995 [JP] Japan ..... 7-045119

[51] Int. Cl.[6] ..... G03G 9/08

[52] U.S. Cl. ..... 430/106.6; 430/120; 399/225

[58] Field of Search ..... 430/120, 109, 430/111, 106, 6; 399/225

[56] References Cited

U.S. PATENT DOCUMENTS

| | | | |
|---|---|---|---|
| 4,957,840 | 9/1990 | Sakashita et al. | 430/106.6 |
| 5,014,089 | 5/1991 | Sakashita et al. | 355/251 |
| 5,137,796 | 8/1992 | Takiguchi et al. | 430/106.6 |
| 5,310,615 | 5/1994 | Tanikawa | 430/106.6 |
| 5,382,624 | 1/1995 | Hotta et al. | 430/109 |
| 5,460,914 | 10/1995 | Sasaki et al. | 430/109 |
| 5,467,174 | 11/1995 | Koga | 430/109 |

FOREIGN PATENT DOCUMENTS

| | | | |
|---|---|---|---|
| 0395026 | 10/1990 | European Pat. Off. | G03G 9/08 |
| 0410483 | 1/1991 | European Pat. Off. | G03G 9/08 |
| 0621513 | 10/1994 | European Pat. Off. | G03G 9/087 |
| 0677794 | 10/1995 | European Pat. Off. | G03G 15/08 |
| 1-112253 | 4/1989 | Japan | G03G 9/08 |
| 1-191156 | 8/1989 | Japan | G03G 13/08 |
| 2-284154 | 11/1990 | Japan | G03G 9/08 |
| 2-284156 | 11/1990 | Japan | G03G 9/08 |
| 2-284158 | 11/1990 | Japan | G03G 9/083 |
| 3-181952 | 8/1991 | Japan | G03G 9/083 |
| 4-162048 | 6/1992 | Japan | G03G 9/08 |

OTHER PUBLICATIONS

Patent Abstracts of Japan, vol. 15, No. 55 (P-1164), Feb. 1991 for JP 2-284158.

*Primary Examiner*—John Goodrow

*Attorney, Agent, or Firm*—Fitzpatrick, Cella, Harper & Scinto

[57] ABSTRACT

A toner for developing electrostatic images is constituted by toner particles comprising a binder resin and a colorant. The toner is characterized by having (i) a particle size distribution including a weight-average particle size $D_4$ of X μm and Y% by number of toner particles having a particle size of at most 3.17 μm satisfying the following conditions (1) and (2):

$$-5X+35 \leqq Y \leqq -25X+180 \quad (1)$$

$$3.5 \leqq X \leqq 6.5 \quad (2),$$

(ii) at least one heat absorption peak in a temperature region of at most 110° C. as measured by differential thermal analysis, and (iii) a tap void of 0.45–0.70. The toner is effective for obviating the sleeve ghost phenomenon.

49 Claims, 7 Drawing Sheets

TONER FOR DEVELOPING ELECTROSTATIC IMAGE, IMAGE FORMING METHOD, DEVELOPING DEVICE AND PROCESS CARTRIDGE

FIELD OF THE INVENTION AND RELATED ART

The present invention relates to a toner for developing electrostatic images, and an image forming method, a developing device and a process cartridge using the developer.

Hitherto, a large number of electrophotographic processes have been known. In these processes, in general, an electrostatic latent image is formed on a photosensitive member comprising a photoconductive material by various means, then the latent image is developed with a toner, and the resultant toner image is, after being transferred onto a transfer material such as paper, as desired, fixed by heating and/or pressing to obtain a copy or a print.

Known methods of developing electrostatic latent images include the cascade developing method, the magnetic brush developing method, and the pressure developing method. Further, there is also known a developing method wherein a magnetic toner is used in combination with a rotating sleeve containing a magnet therein and is caused to jump between the sleeve and a photosensitive member under application of an electric field.

A mono-component developing scheme has an advantage of allowing a developing device which is compact and light in weight, since it does not require carrier particles, such as glass beads or iron powder, as required in a two-component developing scheme. Further, according to the two-component developing scheme, it is necessary to maintain a constant toner concentration in a developer mixture with carrier particles and therefore to use an equipment for detecting the toner concentration and replenishing a necessary amount of toner. This also increases the weight of the developing device. The mono-component developing scheme does not require such equipment and therefore can use a compact and light developing device.

As for printing apparatus, LED printers and LBP printers dominate in the market, and technically a higher resolution is being desired, e.g., from a conventional level of 240 or 300 dpi to 400 dpi or 800 dpi. Correspondingly, a developing scheme of a higher resolution is required. As for copying apparatus, a higher degree of functional apparatus is being desired so that digital image formation is pursued. A digital copying apparatus principally adopts a scheme of forming electrostatic images by laser irradiation suitable for a high resolution image formation. Thus, a developing scheme of a higher resolution or higher definition is also required similarly as in printers. For this reason, a toner of a smaller particle size is being used, and toners of a smaller particle size having a specific particle size distribution have been proposed in Japanese Laid-Open Patent Application (JP-A) 1-112253, JP-A 1-191156, JP-A 2-284156, JP-A 2-284158, JP-A 3-181952 and JP-A 4-162048.

On the other hand, the requirement for graphic images of a higher quality is also intense. An aspect of a graphic image quality is a uniformity of image density in a solid image.

As a problematic phenomenon in connection with the density uniformity in solid images in the mono-component developing scheme, there has been known a phenomenon called "sleeve ghost" that a halftone solid print image is accompanied with an after-image of an immediately preceding print image occurring corresponding to the cycle of a toner-carrying member (sleeve).

More specifically, the sleeve ghost phenomenon most frequently occurs in case where continuous formation of solid white image is followed by formation of a stripe pattern including solid black print stripes and solid white print stripes, followed further by a halftone solid image (ID (image density)=B'), such that the after image of solid white stripes appear in the solid halftone image at parts thereof contiguous to the solid white stripes as image portions having a slightly lower image density (ID=A'<B'), as shown in FIG. 9.

Further, when a fine toner powder layer is formed on the toner carrying member surface to cause an insufficient charge of toner thereon, a non-image part is liable to be developed with the toner to cause "fog".

In order to solve the sleeve ghost problem, JP-A 2-284154 has proposed a negatively chargeable magnetic toner comprising a combination of negatively chargeable toner particles with positively chargeable resin particles and negatively chargeable hydrophobic silica fine powder. However, the negatively chargeable magnetic toner does not have a sufficiently small average particle size and therefore is not fully satisfactory for formation of high resolution-high definition images.

SUMMARY OF THE INVENTION

A generic object of the present invention is to provide a toner having solved the above-mentioned problems.

A more specific object of the present invention is to provide a toner free from or less liable to cause "sleeve ghost".

Another object of the present invention is to provide a toner capable of forming images of higher resolution and higher definition.

Another object of the present invention is to provide a toner having excellent image forming characteristics and capable of providing images having a high image density and accompanied with little fog.

A further object of the present invention is to provide an image forming method, a developing device and a process cartridge using such a toner.

According to the present invention, there is provided a toner for developing electrostatic images, comprising: toner particles comprising a binder resin and a colorant; wherein the toner has:

(i) a particle size distribution including a weight-average particle size $D_4$ of X μm and Y% by number of toner particles having a particle size of at most 3.17 μm satisfying the following conditions (1) and (2):

$$-5X+35 \leqq Y \leqq -25X+180 \quad (1)$$

$$3.5 \leqq X \leqq 6.5 \quad (2),$$

(ii) at least one heat absorption peak in a temperature region of at most 110° C. as measured by differential thermal analysis, and (iii) a tap void of 0.45–0.70.

According to another aspect of the present invention, there is provided an image forming method, comprising:

electrically charging an image-bearing member, forming an electrostatic image on the image-bearing member, and developing the electrostatic image with a toner carried on a toner-carrying member to form a toner image on the image-bearing member;

wherein the toner comprises toner particles comprising a binder resin and a colorant, and satisfies the above-mentioned properties (i), (ii) and (iii).

According to still another aspect of the present invention, there is provided a developing device, comprising:

a toner comprising toner particles comprising a binder resin and a colorant, a toner vessel containing the toner, and a toner-carrying member for carrying and conveying the toner contained in the toner vessel to a developing position, wherein the toner has the above-mentioned properties (i), (ii) and (iii).

According to a further aspect of the present invention, there is provided a process cartridge detachably mountable to a main body of an image forming apparatus, comprising:

an image-bearing member for holding an electrostatic image, and a developing means for developing an electrostatic image held on the image-bearing member to form a toner image on the image-bearing member;

wherein the developing means comprises a toner comprising toner particles comprising a binder resin and a colorant, a toner vessel containing the toner, and a toner-carrying member for carrying and conveying the toner contained in the toner vessel to a developing position, wherein the toner has the above-mentioned properties (i), (ii) and (iii).

These and other objects, features and advantages of the present invention will become more apparent upon a consideration of the following description of the preferred embodiments of the present invention taken in conjunction with the accompanying drawings.

DETAILED DESCRIPTION OF THE INVENTION

From the results of various experiments, we now consider that the sleeve ghost phenomenon occurs according to the following mechanism.

In case where solid white images have been continuously formed, the triboelectric charge of a toner on the toner-carrying member (developing sleeve) is elevated, and particularly fine powdery toner particles having a small particle size are selectively attached to the very surface of the developing sleeve. As a result, toner particles constituting an upper layer on the layer of the toner particles having a high triboelectric charge are caused to have a lower triboelectric charge.

Accordingly, when a development is performed under such conditions that a toner fraction having an appropriate level of triboelectric charge is optimally used for development, the developing efficiency is lowered because the amount of the toner fraction having an appropriate level of triboelectric charge is lowered due to the presence of a considerable proportion of toner fraction having a lower triboelectric charge, thereby resulting in a lowering in image density. The lowering in image density particularly noticeably occurs in a halftone image which is remarkably affected by a lowering in developing efficiency.

Figure 9:
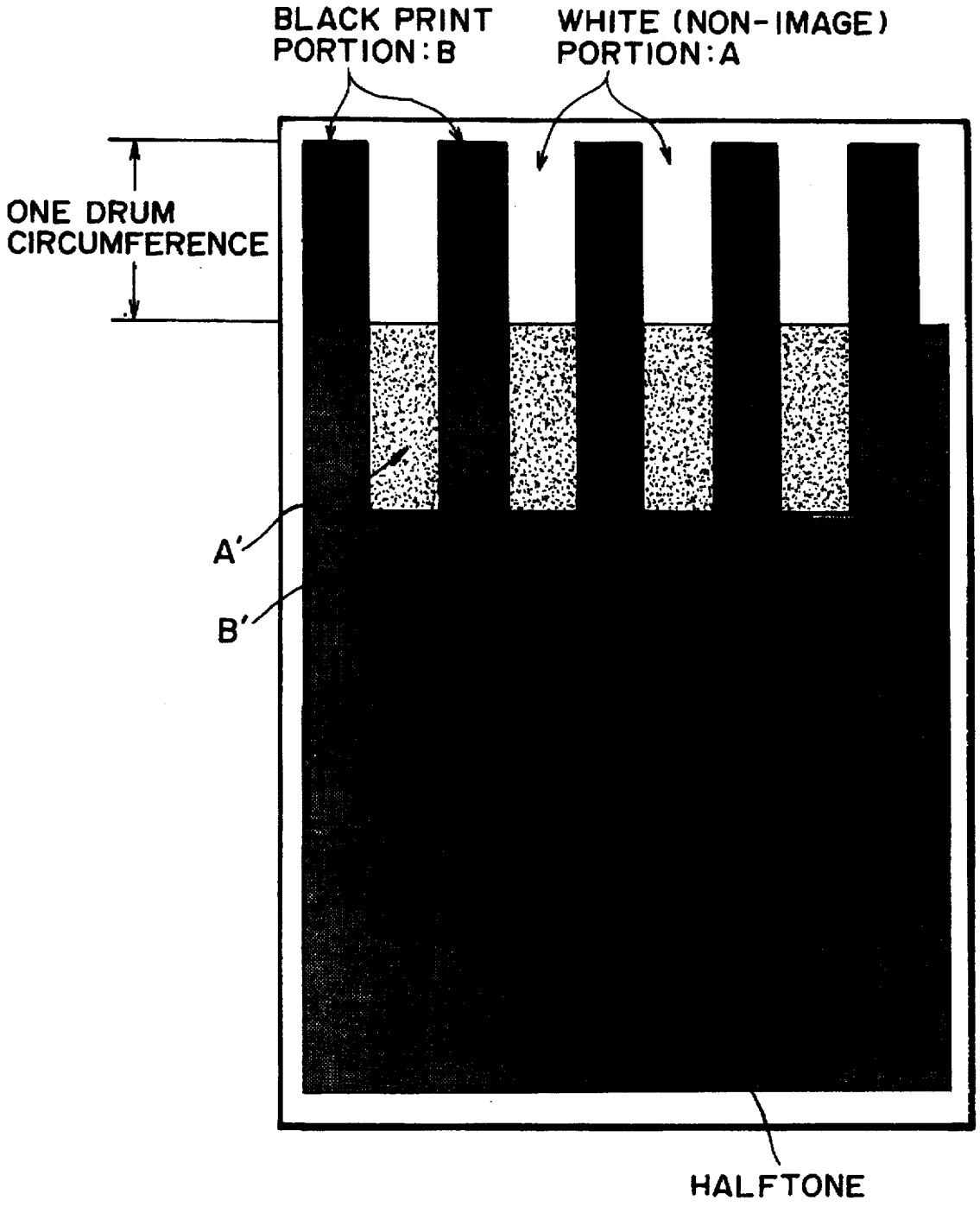
FIG. 9 is an illustration of an image pattern used for sleeve ghost evaluation.

Accordingly, in case of forming a pattern of image as shown in FIG. 9 including black and white stripes followed by a halftone image portion immediately after continuous formation of solid white images, the after-image of white stripes (white image portions) appears in regions contiguous to the white image portions to result in an after-image portion having a lower density.

As described above, the sleeve ghost is caused by a fluctuation in triboelectric charge of respective toner particles in a toner layer formed on the developing sleeve.

The problem accompanying the sleeve ghost is particularly noticeable in the mono-component developing scheme using a magnetic toner.

More specifically, in the case of a mono-component developer comprising a magnetic toner, the magnetic toner in the developer is conveyed while forming ears of magnetic toner particles and thus a toner layer on a developing sleeve surface under the action of a magnetic constraint force exerted by a magnet contained inside the developing sleeve, so that the magnetic toner behaves in the form of such ears of magnetic toner particle at the time of developing an electrostatic latent image in the developing region. As a result, if there are few magnetic toner particles having an appropriate level of triboelectric charge, such magnetic toner particles having an appropriate triboelectric charge are taken in ears of the magnetic toner particles comprising a major proportion of magnetic toner particles not having an appropriate triboelectric charge and thus not readily consumed for development, so that the toner particles having an appropriate triboelectric charge can be hindered from being consumed for the development. Accordingly, the sleeve ghost phenomenon is liable to occur in the case of a mono-component developer comprising a magnetic toner.

As a result of extensive study for solving the sleeve ghost, we have discovered that the formation of a toner layer having a high triboelectric charge on the toner-carrying member can be suppressed and thereby the sleeve ghost can be suppressed by using a toner of the present invention characterized by (i) a specific particle size distribution defined by a relationship between a fine powder fraction content and a weight-average particle size, (ii) a thermal characteristic defined by at least one heat-absorption peak in a temperature region of at most 110° C., and (iii) a specific tap void (i.e., a void ratio of the toner after tapping).

More specifically, the toner according to the present invention is first characterized by (i) a particle size distribution including a weight-average particle size $D_4$ of X μm and Y% by number of toner particles having a particle size of at most 3.17 μm satisfying the following conditions (1) and (2):

$$-5X+35 \leqq Y \leqq -25X+180 \quad (1)$$

$$3.5 \leqq X \leqq 6.5 \quad (2).$$

Figure 1:
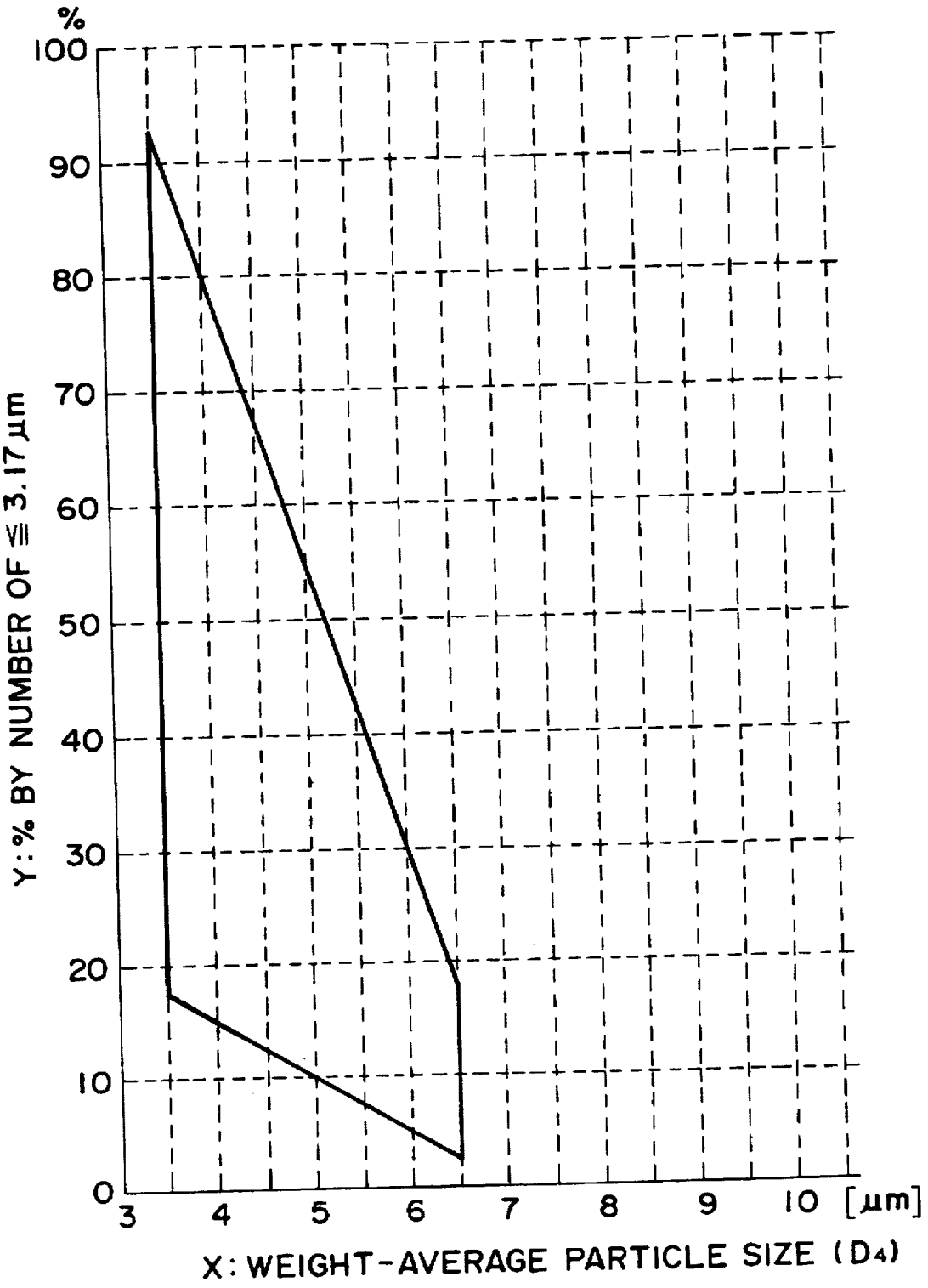
FIG. 1 is a graph showing a particle size distribution range satisfying the conditions of the formulae (1) and (2).

The conditions of the formulae (1) and (2) define a region shown in FIG. 1. It is further preferred that the following conditions (3) and (4) are satisfied:

$$-5X+35 \leqq Y \leqq -12.5X+98.75 \quad (3)$$

$$4.0 \leqq X \leqq 6.3 \quad (4).$$

The region of particle size distribution defined in FIG. 1 is characterized by a considerably smaller weight-average particle size (X, $D_4$) and a considerably larger amount (Y) of the fine toner fraction compared with commercially available toners used at present. In the present invention, the suppression of "sleeve ghost" is intended to be achieved not by reducing the amount of a fine toner faction which has caused a sleeve ghost phenomenon but by reversely causing the entire toner particle size distribution to approach the region of the fine toner fraction, whereby the chargeability of and the image force acting on the entire toner are caused to approach those of the fine toner fraction so as to provide a special charged toner state of the entire toner particles which has not been hitherto achieved on the toner-carrying member, thereby preventing the selective attachment of a fine toner fraction onto the toner-carrying member and the accompanying fine powder layer formation, leading to the sleeve ghost.

More specifically, in the present invention, as the toner has a specific particle size distribution satisfying the conditions (1) and (2), particularly as the particle size distribution of the entire toner has been caused to approach that of the fine toner particles having a particle size of 3.17 μm or below and liable to have a high triboelectric charge, a difference in triboelectric charge based on a particle size difference between the fine toner fraction and the entire toner is reduced, so that the toner particles of a particle size exceeding 3.17 μm are also adequately attached to the very surface of the developing sleeve and the selective attachment of a fine toner fraction leading to the formation of a fine toner powder layer on the very surface of the developing sleeve is suppressed. As a result, the triboelectric charge of the toner layer formed on the developing sleeve surface may be uniformized to suppress the occurrence of sleeve ghost.

However, the accomplishment of the above-mentioned particle size distribution alone is not sufficient to attain a sufficient effect of suppressing the formation of a fine toner fraction layer on the toner-carrying member. A sufficient effect of suppressing the formation of a fine toner fraction layer on the toner-carrying member leading to a satisfactory level of suppression of sleeve ghost can be accomplished by a toner further satisfying (ii) at least one heat absorption peak in a temperature region of at most 110° C., preferably in the region of 60°–110° C., as measured by differential thermal analysis, and (iii) a tap void of 0.45–0.70, in addition to (i) the above-mentioned toner particle size distribution.

The reason why the satisfaction of the above conditions (ii) and (iii) in addition to the condition (i) contributes to the suppression of a fine toner fraction layer formation on the toner-carrying member has not been clarified as yet but may be considered as follows.

The toner according to the present invention shows a dispersibility of an additive, such as a colorant or a magnetic material, in a binder resin component during the melt-kneading step for toner production, which dispersibility is different from that of a toner showing no heat-absorption peak in a region of at most 110° C. according to differential thermal analysis. Accordingly, the resultant toner particles after pulverization are considered to have a special state of exposure of the additive, such as a colorant or a magnetic material, at the toner particle surfaces different from that of toner particles of a toner having no absorption peak in the region of at most 110° C..

More specifically, the additive particles, such as a colorant, a magnetic material or a pigment, liable to be exposed at the surfaces of toner particles after pulverization may be appropriately covered with a resin or a wax having at least one heat-absorption peak in a temperature region of at most 100° C., so that the fluctuation in triboelectric chargeability at local surface parts of toner particles may be suppressed and therefore the fluctuation in triboelectric charge of the respective toner particles in the toner layer formed on the developing sleeve may be suppressed, thereby improving the developing efficiency and suppressing the sleeve ghost.

The toner according to the present invention has a tap void as determined by the following formula of 0.45–0.70 and may preferably have a tap void of 0.50–0.70, further preferably 0.50–0.60, so as to better suppress the sleeve ghost:

tap void=(true density—tap density)/true density.

A toner is triboelectrically charged principally in a state of being packed between the toner-carrying member and a toner regulating blade. Accordingly, the degree of toner packing largely affects the charge of the toner. A tap void (i.e., a void after tapping as a measure of a packing state) of 0.45–0.70 as in the present invention means that the toner is triboelectrically charged in a packing state having more void than in the conventional state. The void-rich packing state may allow a larger mobility of the toner on the toner-carrying member to uniformize the triboelectric charge of the respective particles, thereby promoting a special charged state suppressing the sleeve ghost and allowing a high-density image formation.

Accordingly, it is considered that the toner according to the present invention can have a special chargeability characteristic and an effect of remarkably suppressing the sleeve ghost based on a combination of the effect of suppressing a fluctuation in triboelectric charge of individual toner particles based on different particle sizes attributable to the above-mentioned specific particle size distribution, the effect of suppressing a fluctuation in triboelectric charge of individual toner particles based on a difference in toner particle state attributable the presence of a heat-absorption peak in a specific temperature region, and the effect of suppressing a fluctuation in triboelectric charge of individual toner particles based on a difference in triboelectrification opportunity of individual toner particles attributable to the specific tap void. The above effect is remarkable particularly in the case of a magnetic toner.

Further, in the toner according to the present invention, the particle size distribution of the entire toner has been made closer to that of the fine toner particles of at most 3.17 μm in particle size liable to have a higher triboelectric charge, so that the difference in triboelectric charge between the fine toner fraction and the entire toner due to a difference in particle size difference is reduced. Further, as the fluctuation in triboelectric chargeability at the toner particle surface parts is suppressed, the fluctuation in triboelectric charge of individual toner particles can be suppressed. As a result, at the time of development, an increased proportion of magnetic toner particles are provided with an appropriate level of triboelectric charge, so that magnetic toner particles not having an appropriate level of triboelectric charge are taken in the ears rich in magnetic toner particles having an appropriate level of triboelectric charge to be similarly used for development, whereby a better developing efficiency may be attained to suppress the sleeve ghost.

In case here the amount Y (%) of fine toner fraction (≦3.17 μm) is less than −5X+35, the toner-carrying member is liable to be coated with an excessive amount of toner, so that a ripple-like irregularity is liable to occur.

In case where Y (%) is more than −25X+180, it is difficult to attain the effect of suppressing the formation of a fine toner fraction layer on the toner-carrying member, so that the sleeve ghost is liable to occur.

In case where the weight-average particle size ($D_4$) X (μm) is below 3.5 μm, it becomes difficult to obtain a sufficient image density In case where X (=$D_4$) μm is larger than 6.5 μm, as the particle size of the entire toner is rather remote from that of the fine toner fraction, the effect of suppressing the formation of a fine toner fraction layer on the toner-carrying member is reduced, so that the sleeve ghost is liable to occur.

It is effective in order to further suppress the sleeve ghost that the toner according to the present invention satisfies a specific relationship regarding a number-basis percentage of those ultra-fine toner fraction of at most 2.52 μm in particle size (within the fine toner fraction of at most 3.17 μm) with respect to the weight-average particle size of the toner. More specifically, the toner according to the present invention may preferably have a particle size distribution including Z% by number of toner particles having a particle size of at most 2.52 μm relative to the weight-average particle size ($D_4$) of X (μm) of the toner satisfying the following condition (5):

$$-7.5X+45 \leq Z \leq -12.0X+82 \quad (5),$$

in order to further effectively suppress the sleeve ghost. This may be attributable to the following reason.

The ultra-fine toner fraction of at most 2.52 μm, because of its small particle size and high triboelectric charge, has a high effect of developing a halftone image which cannot be readily developed with a toner fraction having a larger particle size, so that it may exhibit a higher performance of developing a halftone image after formation of solid white images, thereby preventing the occurrence of sleeve ghost.

As for a halftone image, a large particle size-toner having a low triboelectric charge shows a low developing performance for an analog latent image because of a low developing contrast of the analog latent image and for a digital latent image because the latent image is composed of minute isolate dots, so that such a large particle size toner having a low triboelectric charge shows a low developing performance for a halftone image anyway.

In case where the proportion Z (% by number) of toner particles having a particle size of at most 2.52 μm is less than −7.5X+45, the toner is liable to show a low developing performance for a halftone image, thus showing a low sleeve ghost-suppression effect. In case where Z (% by number) is larger than −12.0X+82, fog and a lowering in image density are liable to occur.

It is further preferred that the toner contains at least 62% by number of toner particles having a particle size of at most 5.04 μm so as show a better sleeve ghost-suppression effect. In case where the content of the toner particles having a particle size of at most 5.04 μm is below 62% by number, the proportion of toner particles having a relatively large particle size is increased so that the effect of suppressing the fine toner fraction layer on the toner-carrying member is somewhat lowered.

In case where the toner shows a heat-absorption peak only in a temperature region exceeding 110° C. as measured by differential thermal analysis, it becomes difficult to decrease the difference in triboelectric charge between the fine toner fraction and the entire toner, the desired effect of suppressing the formation of a fine toner fraction layer on the toner carrying member cannot be attained, so that the sleeve ghost is liable to occur.

The toner may be provided with at least one heat-absorption peak in the region of at most 110° C. by incorporating a low-melting point substance showing a heat-absorption peak in a region of at most 110° C., preferably 60°–110° C..

Such a low-melting point substance may comprise a resin or a wax or waxy substance.

Examples of the resin may include crystalline polyester resin and silicone resin.

Examples of the wax or waxy substance may include: paraffin wax and its derivatives; montan wax and its derivatives microcrystalline wax and its derivatives; Fischer-Tropsch wax and its derivatives; polyolefine wax and its derivatives; natural waxes, such as carnauba wax and candelilla wax, and their derivatives; alcohols, such as higher fatty alcohols; fatty acids, such as stearic acid and palmitic acid, and their compounds; acid amides and their derivatives, esters and their derivatives; ketones and their derivatives; hardened castor oil and its derivatives; vegetable waxes; animal waxes; mineral waxes; and petrolactam. The derivatives may include: oxides, block copolymers with vinyl monomers, and graft-modified products. In the present invention, in addition to the above-enumerated examples, it is possible to use any (waxy) substances as far as they have at least one heat-absorption peak in the region of at most 110° C. as measured by differential thermal analysis.

In the present invention, it is also possible to use a wax having no heat-absorption peak according to differential thermal analysis in addition to the substance having at least one heat-absorption peak in the temperature region of at most 110° C.

In case where the toner has a tap void below 0.45, it becomes difficult to satisfy the suppression of sleeve ghost and the provision of a high image density. Above 0.70, the toner coating layer formed on the toner carrying member becomes ununiform to result in a lower image uniformity.

The particle size distribution of a toner may be measured by using a Coulter counter Model TA-II or Coulter Multisizer (available from Coulter Electronics Inc.) together with a 1%-NaCl aqueous solution as an electrolytic solution prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 μm by using the above-mentioned apparatus with a 100 μm-aperture to obtain a volume-basis distribution and a number-basis distribution.

The weight-basis average particle size $D_4$ may be obtained from the volume-basis distribution while a central value in each channel is taken as a representative value for each channel. Similarly, the number-basis percentages of particles having particle sizes of at most 5 μm, at most 3.17 μm and at most 2.52 μm may respectively be obtained from the number-basis distribution.

The heat-absorption peaks according to differential thermal analysis referred to herein are based on the values measured by using a high-accuracy internal heating input compensation-type differential scanning calorimeter (OSC). A commercially available example thereof is "DSC-7" (trade name) mfd. by Perkin-Elmer Corp. In this case, it is appropriate to use a sample weight of about 10–15 mg for a toner sample or about 2–5 mg for a wax sample.

The measurement may be performed according to ASTM D3418-82. Before a DSC curve is taken, a sample (toner or wax) is once heated for removing its thermal history and then subjected to cooling (temperature decrease) and heating (temperature increase) respectively at a rate of 10° C./min. in a temperature range of 0° C. to 200° C. for taking DSC curves.

The heat-absorption temperature described herein refers to a peak temperature in a positive direction, i.e., a temperature at which the differential of a DSC curve turns from a positive to a negative.

The true density of a toner may be measured in the following manner.

1 g of a sample toner is charged in a pelletizer for making a pellet sample for IR measurement and pelletized under a pressure of ca. 1.96 MPa (200 kg.f/cm$^2$). The volume and weight of the resultant sample are measure to obtain a true density.

The tap density of a toner may be measured by using a powder tester ("Powder Tester", available from Hosokawa Micron K.K.) together with an accessory vessel attached to the powder tester along with the procedure stipulated in the instruction manual of the powder tester.

The toner according to the present invention may preferably comprise a binder resin having an acid value of at most 15 mgKOH/g, more preferably at most 12 mgKOH/g, so as to better suppress the sleeve ghost and provide a better image density.

This is because a binder resin having an acid value of at most 15 (mgKOH/g) provides a state of relatively few charging active acid groups. Such a binder resin having a low charging activity may be effective in stabilizing the specific chargeability of the toner according to the present invention at an appropriate level, so as to better suppress the sleeve ghost and fog and provide a better image density.

The acid value refers to an amount (mg) of KOH (potassium hydroxide) required for neutralizing an acid contained in 1 g of a sample.

The avid value of a binder resin may be measured in the following manner. Ca. 2 g of a pulverized sample is accurately weighed (W (g)). The sample is placed in a 200 ml-Erlenmeyer flask, and 100 ml of a toluene/ethanol (2/1) mixture solution is added thereto for dissolution in 5 hours. A phenolphthalein solution is added thereto as an indicator. The above solution is titrated with a 0.1N KOH alcohol solution added through a buret. The amount of KOH solution used for titration is denoted by S (ml). Separately, a blank test is performed to measure the amount (B (ml)) of the KOH solution used for the titration. The acid value of the sample is calculated from the following equation:

$$\text{Acid value}=[(S-B)\times f\times 5.61]/W,$$

wherein f denotes the factor of the KOH solution.

The binder resin for providing a toner for heat fixation may for example comprise: homopolymers of styrene and derivatives thereof, such as polystyrene, poly-p-chlorostyrene and polyvinyltoluene; styrene copolymers such as, styrene-vinylnaphthalene copolymer, styrene-acrylate copolymer, styrene-methacrylate copolymer, styrene-maleic acid ester copolymer, styrene-acrylic acid copolymer, styrene-methacrylic acid copolymer, styrene-maleic acid copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrileindene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, coumarone-indene resin and petroleum resin.

Among the above, styrene copolymers are preferred as a binder resin so as to provide a high image density in a high humidity environment.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers. The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

Some monomers may be used for adjusting the acid value of the resultant binder resin. Examples of such monomers may include: acrylic acid and α- or β-alkyl derivatives thereof such as acrylic acid, methacrylic acid, α-ethylacrylic acid, and crotonic acid; unsaturated dicarboxylic acids, such as fumaric acid, maleic acid are citraconic acid, are monoester derivatives thereof, and maleic anhydride. These monomers may be used alone or in mixture for copolymerization with another monomer to provide a desired polymer.

Among the above, it is particularly preferred to use a monoester derivative of unsaturated dicarboxylic acid, examples of which may include: monoesters of α,β-unsaturated dicarboxylic acids, such as monomethyl maleate, monoethyl maleate, monooctyl maleate, monoallyl maleate, monophenyl maleate, monomethyl fumarate, monobutyl fumarate, and monophenyl fumarate; monoesters of alkenyldicarboxylic acids, such as monobutyl n-butenylsuccinate, monomethyl n-octenylsuccinate, monobutyl n-butenylmalonate, monomethyl n-butenyladipate; and monoesters of aromatic dicarboxylic acids, such as momethyl phthalate, monoethyl phthalate, and monobutyl phthalate.

A toner for a pressure fixation scheme may be constituted by using a binder resin, such as low-molecular weight polyethylene, low-molecular weight polypropylene, ethylene-vinyl acetate copolymer, ethylene-acrylate copolymer, higher fatty acid, polyamide resin or polyester resin. These resins may be used singly or in mixture.

It is preferred that the toner according to the present invention contains an azo metal complex so as to better suppress the sleeve ghost and fog and provide high image densities.

A preferred class of azo metal complex may be represented by the following formula:

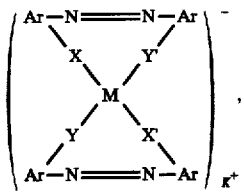

wherein M denotes a coordination center metal, such as Sc, Ti, V, Cr, Co, Ni, Mn or Fe; Ar denotes an aryl group, such as phenyl or naphthyl, capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $K^+$ denotes hydrogen, sodium, potassium, ammonium or aliphatic ammonium or nothing.

It is particularly preferred to use an azo metal complex of the above formula wherein the center metal M is Fe (iron), particularly in a proportion of at least 1.1 wt. %, more preferably at least 1.3 wt. %, so as to better suppress the sleeve ghost and fog and provide a better image density.

This inclusion of the azo metal complex (particularly having Fe as its center metal and used in a relatively large amount of at least 1.1 wt. %), because of its charge controllability and manner of exposure at the toner surface, may be considered to stabilize the special chargeability of the toner according to the present invention at an appropriate level, thereby better suppressing the sleeve ghost and fog and providing a better image density.

The toner according to the present invention may preferably be in the form of a magnetic toner containing a magnetic material in the toner particles.

The magnetic material may preferably be in the form of powder of an alloy or a compound containing a ferromagnetic element. Examples thereof may include known magnetic material inclusive of: iron oxides, such as magnetite, hematite and ferrite; alloys or compounds of iron, cobalt, nickel, manganese, and zinc; and other ferromagnetic alloys.

The magnetic powder may preferably have a BET specific surface area according to the nitrogen adsorption method of 1–40 $m^2/g$, more preferably 2–30 $m^2/g$. Below 1 $m^2/g$, the magnetic powder is liable to show a poor dispersion in the binder resin, thus resulting in fog. Above 40 $m^2/g$, the resultant toner is liable to provide a low image density in a high temperature/high humidity environment.

The magnetic powder may preferably have an average particle size of 0.05–1 μm, more preferably 0.1–0.6 μm. Below 0.05 μm, the resultant toner is liable to provide a low image density in a high temperature/high humidity environment. Above 1.0 μm, the magnetic powder shows a poor dispersibility in the binder resin to result in fog.

The magnetic material may preferably be contained in a proportion of 60–200 wt. parts, further preferably 80–150 wt. parts, per 100 wt. parts of the binder resin. Below 60 wt. parts, the resultant toner particles are liable to receive too small a magnetic force, thus resulting in fog. Above 200 wt. parts, the resultant toner particle are liable to receive too large a magnetic force, thus resulting in a low image density.

The use of a magnetic iron oxide containing silicon or aluminum element may provide better performances of suppressing the sleeve ghost and fog and providing a high image density.

The inclusion of silicon or aluminum element in magnetic iron oxide is considered to provide an improved toner releasability from the toner-carrying member, thereby providing an improved developing performance, and providing a uniform chargeability to the toner particles of respective particle sizes.

Thus, in the toner according to the present invention showing a special chargeability, the silicon or aluminum element contained in the magnetic iron oxide particles exposed to the toner particle surfaces functions to reduce the difference in triboelectric charge between the fine toner fraction and the entire toner, thereby preventing the formation of a fine toner fraction layer on the toner-carrying member, thus better suppressing the sleeve ghost and fog and providing a better image density characteristic.

The silicon element may preferably be contained in an amount of 0.1–3 wt. % of the iron element. The aluminum element may preferably be contained in an amount of 0.01–2 wt. % of the iron element.

The silicon or aluminum element may preferably be present preferentially at the magnetic iron oxide surface so as to provide a better charge controlling performance to the magnetic iron oxide.

The presence and content of the silicon or aluminum element in the magnetic iron oxide may be determined by a fluorescent X-ray analyzer.

The toner according to the present invention may preferably contain a substantially spherical magnetic material so as to better suppress the sleeve ghost and a better image density.

This is presumably because spherical particles of magnetic material are not readily exposed to the toner particle surfaces, thereby uniformizing the toner chargeability of the entire toner and stabilizing the special chargeability of the toner according to the present invention at an appropriate level so as to better suppress the sleeve ghost and provide a better image density Herein, the term "substantially spherical" used for magnetic material particles means that the particles (more than 100 particles) of a magnetic material show an average long axis/short axis ratio in the range of 1.0–1.2 based on photographs taken through an electron microscope.

The toner according to the present invention may preferably include inorganic fine powder treated with silicone oil in addition to the toner particles, so as to better suppress the sleeve ghost and fog and provide a high image density. So as to provide better performances, it is further preferred that the silicone oil-treated inorganic fine powder has a pH of at most 7, more preferably at most 6.7.

This is presumably because the silicone oil-treated inorganic fine powder, particularly one having an acidic side pH of at most 7.0 (preferably at most 6.7), has an appropriate negative charge controllability, thereby stabilizing the special chargeability of the toner according to the present invention at an appropriate level to better suppress the sleeve ghost and fog and provide a better image density.

The silicone oil-treated inorganic fine powder may preferably be blended with toner particles under stirring by means of a blender, such as a Henschel mixer. The negative charge controllability of the silicone oil-treated inorganic fine powder may be better exhibited when the powder is present at the toner particle surfaces.

The inorganic fine powder used in the present invention may preferably comprise fine powder of silica, titanium oxide or aluminum oxide. Particularly, silica fie powder is preferred because of appropriate negative chargeability. The silica fine powder may be dry process silica (sometimes called fumed silica) formed by vapor phase oxidation of a silicon halide or wet process silica formed from water glass. However, dry process silica is preferred because of fewer silanol groups at the surface and inside thereof and also fewer production residues such as $Na_2O_3$ and $SO_3$. The dry process silica can be in the form of complex metal oxide powder with other metal oxides for example by using another metal halide, such as aluminum chloride or titanium chloride together with silicon halide in the production process. Silica fine powder herein may include such complex metal oxide powder.

The silicone oil may be one having a viscosity at 25° C. of 0.5–10000 cSt (centi-Stokes), preferably 1–1000 cSt, further preferably 10–200 cSt. Particularly preferred examples thereof may include: dimethylsilicone oil, methylphenylsilicone oil, α-methylstyrene-modified silicone oil, chlorophenylsilicone oil, and fluorine-containing silicone oil. The silicone oil treatment may be performed, e.g., by directly blending silica fine powder preliminarily treated with a silane coupling agent and silicone oil by means of a blender such as a Henschel mixer; by spraying silicone oil onto base silica fine powder; or by dissolving or dispersing silicone oil in an appropriate solvent and adding thereto silica fine powder for blending, followed by removal of the solvent.

It is preferred to heat the inorganic fine powder after the silicone oil treatment in an inert gas atmosphere at a temperature of at least 200° C., more preferably at least 250° C., so as to stabilize the surface coating.

It is preferred to use inorganic fine powder treated with both a coupling agent and silicone oil, either by treating the inorganic fine powder first with a coupling agent and then with silicone oil or by treating the inorganic fine powder simultaneously with a silane coupling agent and silicone oil.

The coupling agent may be a silane coupling agent or a titanate coupling agent.

Examples of such a silane coupling agent may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

It is also possible to use a nitrogen-containing silane coupling agent, examples of which may include: aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine and trimethoxysilyl-γ-propylbenzylamine. These may also be used singly or in mixture of two or more species.

The use of hexamethyldisilazane (HMDS) is particularly preferred.

The silicone oil-treated inorganic fine powder may preferably have a BET specific surface area of at least 50 $m^2/g$, particularly 70–400 $m^2/g$.

The silicone oil-treated inorganic fine powder may preferably be used in a proportion of at least 1.0 wt. parts, more preferably at least 1.2 wt. parts, further preferably 1.2–5.0 wt. parts, most preferably 1.2–3.0 wt. parts, per 100 wt. parts of the toner, especially in the case of the treated silica fine powder.

The pH measurement of a powder may be performed by using a pH meter using a glass electrode. More specifically, 4 g of a sample is weighed into a beaker and 50 $cm^3$ of methanol is added thereto to wet the sample. Further, 50 $cm^3$ of pure water is added thereto and the mixture is stirred sufficiently by a homo-mixer followed by pH measurement by the pH meter.

The toner particles used in the present invention can be further blended with external additives inclusive of: powder of lubricants, such as polytetrafluoroethylene, zinc oxide, and polyvinylidene fluoride; abrasives, such as cerium oxide, silicon carbide, and strontium titanate; flowability-improving agents, such as titanium oxide and aluminum oxide; anti-caking agents, and conductivity-imparting agents, such as carbon black, zinc oxide and tin oxide.

The toner particles used in the present invention may preferably be produced through a process including at least the steps of: blending the above-mentioned ingredients (except for external additives, such as the silicone oil-treated inorganic fine powder) by means of a blender, such as a Henschel mixer, a ball mill, and a V-shaped blender; melt-kneading the blend by means of a hot kneader, such as a heated roll kneader and an extruder; and pulverizing the kneaded product after cooling and solidification by means of a pulverizer, such as a jet mill. It is of course preferred to include a step of classifying the pulverized product.

Through the above steps, it is possible to obtain toner particles basically satisfying the characteristic conditions (i) and (ii) (a specific particle size distribution and a specific thermal characteristic) of the toner according to the present invention. Because of the thermal characteristic, the toner particles are provided with special surface exposure states of internal additives, such as a colorant, a magnetic material and a charge control agent.

The toner particles may be further blended with external additives as described by means of a blender, such as a Henschel mixer to obtain the toner according to the present invention.

The toner thus-produced according to the present invention may be used as a mono-component type developer consisting principally of the toner or used to constitute a two-component type developer consisting principally of the toner and a carrier. However, the above-mentioned sleeve ghost-suppression effect may be remarkably exhibited in a mono-component type developer, which is accordingly preferably constituted by the toner according to the present invention.

More specifically, in the case of two-component type developer, the above-mentioned sleeve ghost phenomenon is essentially not liable to occur because of a difference in developing mechanism. However, even in the case of a two-component type developer, a conventional toner is liable to cause the selective attachment of a fine toner fraction onto the carrier surface and lower the chargeability of the toner to result in fog. To the contrary, the toner according to the present invention having a specific particle size distribution and having at least one heat-absorption peak in a temperature region of at most 110° C. is not liable to cause the selective attachment of a fine toner fraction resulting in a fine toner fraction layer, and the surface of the colorant, such as a pigment exposed to the toner particle surface is appropriately covered, so that the toner retains a good chargeability and provides high-density images free from fog. Thus, the toner according to the present invention is also preferably used in a two-component type developer.

Now, the image forming method, developing device and process cartridge using the toner according to those present invention will be described with reference to the drawings.

First, a developing device using a magnetic toner is described with reference to FIG. 2.

Figure 2:
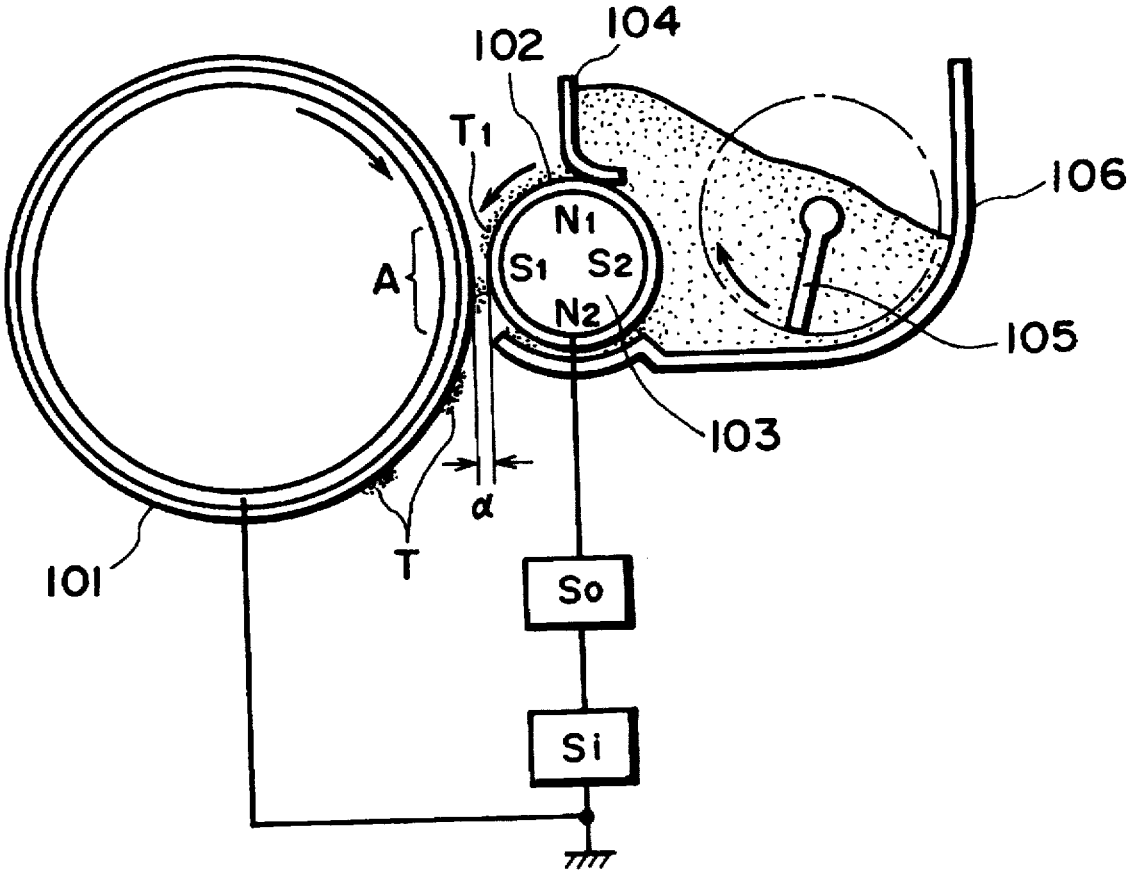
FIG. 2 is a schematic view of an image forming apparatus including a developing device using a mono-component magnetic developer for illustrating an embodiment of the image forming method according to the present invention.

Referring to FIG. 2, almost a right half of a developing sleeve (toner-carrying member) 102 is always contacted with a toner stock in a toner vessel 106, and the toner in the vicinity of the developing sleeve surface is attached to the sleeve surface under a magnetic force exerted by a magnetic force generating means 103 in the sleeve 102 and/or an electrostatic force. As the developing sleeve 102 is rotated, the magnetic toner layer is formed into a thin magnetic toner layer $T_1$ having an almost uniform thickness while moving through a toner layer thickness-regulating member 104. The magnetic toner is charged principally by a frictional contact between the sleeve surface and the magnetic toner near the sleeve surface in the toner stock caused by the rotation of the developing sleeve 102. The magnetic toner thin layer on the sleeve is rotated to face a photosensitive member 101 in a developing region A at the closest gap a between the latent image-bearing member 101 and the developing sleeve. At the time of passing through the developing region A, the magnetic toner in a thin layer is caused to jump and reciprocally move through the gap a between the photosensitive member 101 and the developing sleeve 102 surface at the developing region A under an AC-superposed DC electric field applied between the photosensitive member 101 and the developing sleeve. Consequently, the magnetic toner on the developing sleeve 102 is selectively transferred and attached to form a toner image T on the latent image-bearing member depending on a latent image potential pattern on the photosensitive member 101.

The developing sleeve surface having passed through the developing region A and selectively consumed the magnetic toner is returned by rotation to the toner stock in the vessel 106 to be replenished with the magnetic toner, followed by repetition of the magnetic thin toner layer $T_1$ on the sleeve 102 and development at the developing region A.

The toner layer thickness-regulating member used in the present invention may be either a metal or magnetic blade disposed with a spacing from a developing sleeve (toner-carrying member) or an elastic blade (104 shown in FIG. 2) which is elastically abutted to the sleeve surface. The toner according to the present invention shows a better sleeve ghost-suppressing performance when used in combination with such an elastic blade abutted against the toner-carrying member for regulating the toner layer thickness. This is presumably for the following reason.

As described hereinabove, the toner packing state is a major factor of determining a toner charge state. When the toner layer thickness-regulating member is constituted by an elastic blade abutted against the toner-carrying member surface, toner particles of different particle sizes may be provided with a more uniform opportunity of contact with the toner-carrying member to be charged uniformly. Further, the toner according to the present invention may be provided with a packing state to promote the spherical charged state for suppressing the formation of a fine toner fraction layer on the toner-carrying member, thereby better suppressing the sleeve ghost.

The elastic blade may comprise, e.g., elastomers, such as silicone rubber, urethane rubber and NBR; elastic synthetic resins, such as polyethylene terephthalate; and elastic metals, such as steel and stainless steel. A composite material of these can also be used. It is preferred to use an elastomeric blade.

The material of the elastic blade may largely affect the chargeability of the toner on the toner-carrying member (sleeve). For this reason, it is possible to add an organic or inorganic substance to the elastic material as by melt-mixing or dispersion. Examples of such additive may include metal oxide, metal powder, ceramics, carbon, whisker, inorganic fiber, dye, pigment and surfactant. In order to control the charge-imparting ability, it is also possible to line the part of an elastic blade of a rubber, synthetic resin or metal abutted to the sleeve with a charge-controlling substance, such as a resin, rubber, metal oxide or metal. If the durability is required of the elastic blade and the sleeve, it is preferred to line the part abutted to the sleeve of a metal elastic blade with a resin or rubber.

In the case of a negatively chargeable magnetic toner, it is preferred to use urethane rubber, urethane resin, polyamide, nylon or a material readily chargeable to a positive polarity as a blade material or a charge-controlling substance. In the case of a positively chargeable toner, it is preferred to use urethane rubber, urethane resin, fluorine-containing resin (such as teflon resin), polyimide resin, or a material readily chargeable to a negative polarity as a blade material or a charge-controlling substance.

When the portion abutted to the toner-carrying member of the blade is formed as a molded product of a resin or rubber, it is preferable to incorporate an additive, inclusive of metal oxides, such as silica, alumina, titania, tin oxide, zirconium oxide and zinc oxide; carbon black and a charge control agent generally used in a toner.

An upper side of the elastic blade is fixed to the developer vessel and the lower side is pressed with a bending in resistance to the elasticity of the blade against the developing sleeve so as to extend in a direction forward or reverse (as shown in FIG. 2) with respect to the rotation direction of the sleeve and exert an appropriate elastic pressure against the sleeve surface with its inner side (or outer side in case of the reverse abutment). The relevant parts of image forming apparatus including a developing apparatus using an elastic blade are for example shown in FIGS. 2–5.

The abutting pressure between the blade and the sleeve (toner-carrying member) may be at least 0.98 N/m (1 g/cm), preferably 1.27–245 N/m (3–250 g/cm), further preferably 4.9–118 N/m (5–120 g/cm), in terms of a linear pressure along the generatrix of the sleeve. Below 0.98 N/m (1 g/cm), the uniform application of the toner becomes difficult, thus resulting in a broad charge distribution of the toner causing fog or scattering. Above 245 N/m (250 g/cm), an excessively large pressure can be applied to the toner to cause deterioration and agglomeration of the toner.

The spacing α between the latent image-bearing member and the developing sleeve may be set to e.g., 50–500 μm.

The thickness of the toner layer on the sleeve is most suitably smaller than the gap α so as to prevent the occurrence of fog. It is however possible to set the toner layer thickness such that a portion of many ears of magnetic toner can touch the photosensitive member.

In the present invention, it is preferred that an electric field including an AC component is applied as an alternating developing bias voltage between the toner-carrying member and the photosensitive member. The AC frequency may be 1.0–5.0 kHz, preferably 1.0–3.0 kHz, further preferably 1.5–3.0 kHz. The alternating bias voltage waveform may be rectangular, sinusoidal, saw teeth-shaped or triangular. A normal-polarity voltage, a reverse-polarity voltage or an asymmetrical AC bias voltage having different durations for positive and negative voltages may also be used.

The sleeve (toner-carrying member) may be composed of a metal or a ceramic, preferably of a non-magnetic electroconductive metal, such as aluminum or stainless steel (SUS), in view of charge-imparting ability. The sleeve can be used in an as-drawn or as-cut state. However, in order to control the toner conveying ability and triboelectric charge-imparting ability, the sleeve may be ground, roughened in a peripheral or longitudinal direction, blasted or coated. In the present invention, it is preferred to use a sleeve blasted with definite-shaped particles and/or indefinite-shaped particles. These particles may be used singly, in mixture or sequentially for blasting.

The toner according to the present invention can show a better sleeve-ghost suppression effect when it is used in combination with a sleeve surfaced with a resinous coating layer containing electroconductive fine particles. This is presumably because a low dielectric constant of a resin may promote the special charged state of the toner according to the present invention.

The electroconductive fine particles contained in such a resinous coating layer surfacing the toner-carrying member may preferably comprise one or more species of carbon black, graphite, electroconductive metal oxides such as electro-conductive zinc oxide, and electroconductive metal double oxides. The electroconductive fine particles may be dispersed within a resin, such as phenolic resin, epoxy resin, polyamide resin, polyester resin, polycarbonate resin, polyolefin resin, silicone resin, fluorine-containing resin, styrene resin, or acrylic resin. A thermosetting resin or a photocurable resin is particularly preferred.

Figure 5:
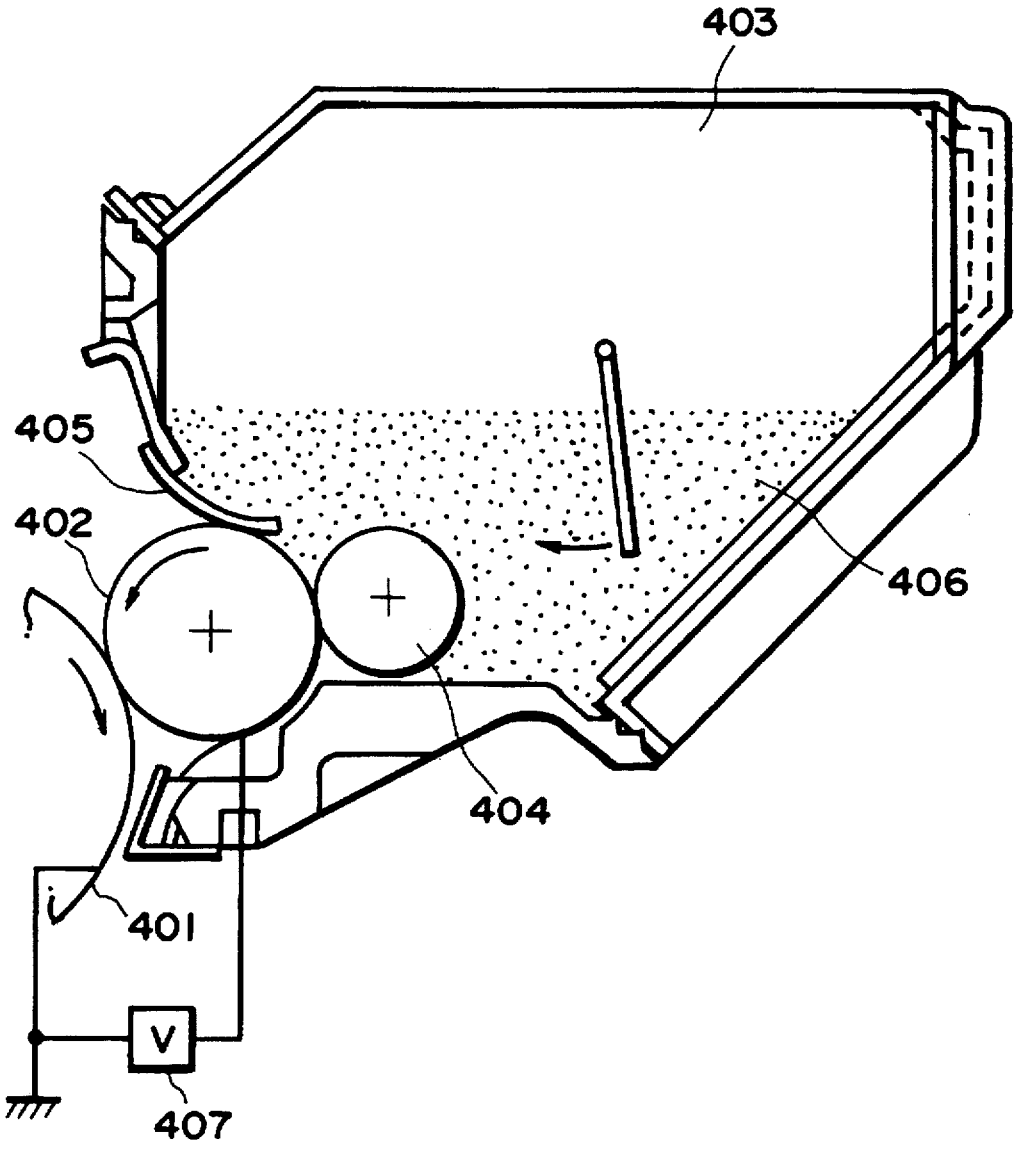
FIG. 5 is a schematic view of an image forming apparatus including a developing device using a mono-component non-magnetic developer for illustrating an embodiment of the image forming method according to the present invention.

Next, a developing method using a non-magnetic toner will be described for example. FIG. 5 shows a developing device for developing an electrostatic image formed on a photosensitive member (as a latent image-bearing member) 401. The electrostatic image may be formed by an electrophotographic means or electrostatic recording means (not shown). The developing device includes a developing sleeve (toner-carrying member) 402 which is a non-magnetic sleeve composed of aluminum or stainless steel.

The developing sleeve can comprise a crude pipe of aluminum or stainless steel as it is. However, the surface thereof may preferably be uniformly roughened by blasting with glass beads, etc., mirror-finished or coated with a resin. The developing sleeve is similar to the one used in the magnetic monocomponent developing method.

Toner 406 is stored in a toner vessel 403 and supplied to the developing sleeve 402 by a supply roller 404. The supply roller 404 comprises a foam material, such as polyurethane foam and is rotated at a non-zero relative speed with the developing sleeve 402 in a direction identical or reverse to that of the developing sleeve. In addition to the toner supply, the supply roller 404 functions to peel off the toner remaining on the developing sleeve 402 without being used after the development. The developer supplied to the developing sleeve 402 is uniformly applied by a toner-applicator blade 405 to form a thin layer on the sleeve 402.

The blade material, abutting means, sleeve material, spacing between the photosensitive member and the sleeve and bias voltage applied to the sleeve are similar to those adopted in the developing method using a magnetic toner described with reference to FIG. 2.

Figure 6:
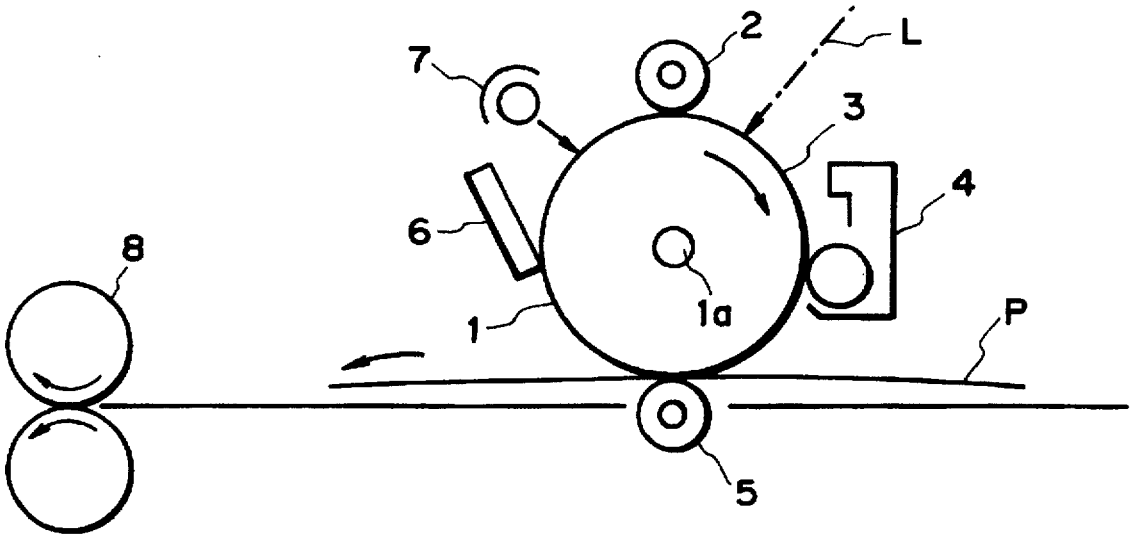
FIG. 6 is another schematic view of an image forming apparatus for illustrating an embodiment of the image forming method according to the present invention.

Now, an image forming method according to the present invention including a developing device using a magnetic toner or a developing device using a non-magnetic toner described above as a developing means will be described with reference to FIG. 6 showing a transfer-type electrophotographic apparatus including a drum-type photosensitive member.

Referring to FIG. 6, a drum-type photosensitive member 1 is rotated abut an axis 1*a* in an arrow direction at a prescribed peripheral speed. During the rotation, the photosensitive member 1 is uniformly charged positively or negatively on its peripheral surface by a roller charger 2 as a charging means and then exposed to image light L (slit exposure light or laser scanning beam) with a latent image-forming means (not shown) at an exposure position 3, whereby an electrostatic image corresponding to exposure light image is formed on the peripheral surface of the photosensitive member.

Then, the electrostatic image is developed with a toner by a developing means 4 to form a toner image, which is successively transferred by the action of a roller charger 5 (as a transfer means) onto a transfer-receiving material (paper) P supplied from a paper supply unit (not shown) to a position between the photosensitive member 1 and the roller charger 5 in synchronism with the rotation of the photosensitive member 1.

The transfer-receiving material P having received the transferred toner image is separated from the photosensitive member surface, introduced to an image fixing means 8 to form a fixed toner image thereon and discharged out of the apparatus as a printed material.

The surface of the photosensitive member 1 after the image transfer is cleaned by removing transfer-residual toner by a cleaning means 6 and further charge-removed by pre-exposure means 7 to be recycled for a subsequent image forming cycle.

As the charging means 2 for uniformly charging the photosensitive member 1, it is preferred to used a contact charging means, such as a roller charger as shown, abutted against the photosensitive member, so as to suppress the occurrence of ozone at the time of charging, but it is also possible to use a conventional corona charger in combination with an ozone filter. Similarly, the transfer means 5 may preferably be a contact charging means, such as a roller charger as shown, but can be a conventional corona charger in combination with an ozone filter.

Figure 7:
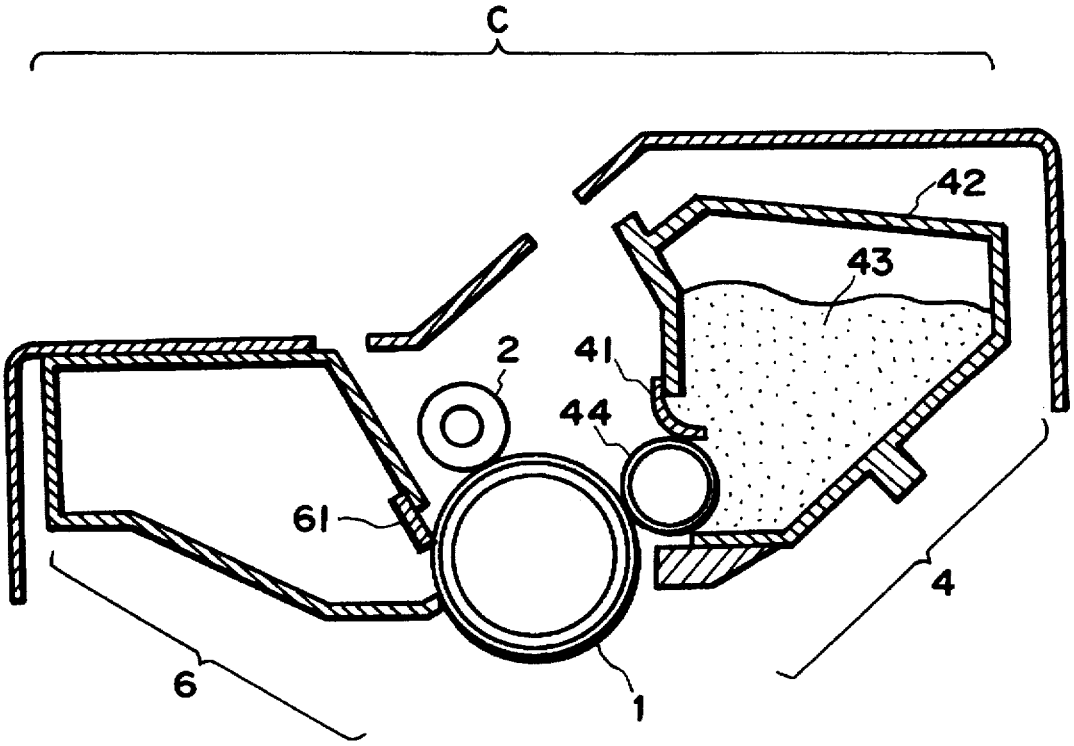
FIG. 7 is an illustration of a process cartridge according to the present invention.

FIG. 7 shows an embodiment of the process cartridge according to the present invention, wherein members similar to those in the apparatus of FIG. 6 are denoted by the same reference numerals.

The process cartridge according to the present invention includes at least a developing means and a latent image-bearing member integrated into a cartridge, which can be detachably mountable to a main body of an image forming apparatus (such as a copying machine, a laser beam printer or a facsimile apparatus).

Referring to FIG. 7, a process cartridge C integrally includes a developing means 4, a drum-type latent image-bearing member (photosensitive drum) 1, a cleaning means 6 including a cleaning blade 61, and a corona charging means 2 as a primary charging means.

In this embodiment, the developing means 4 includes an elastic blade 41 (toner layer-thickness regulating means), a toner vessel 42 containing a mono-component type developer 43 comprising a toner, and a developing sleeve 44 (as a toner-carrying member). For development, the toner 43 is transferred from the sleeve 44 to the photosensitive drum 1 under the action of an electric field formed between the photosensitive drum 1 and the sleeve 44 by a developing bias voltage supplied from a bias application means (included in the apparatus main body, not shown). In order to form a prescribed electric field to suitably perform the development, it is very important to form an accurate gap between the photosensitive drum 1 and the developing sleeve 44.

The cartridge according to the above embodiment integrally includes four members of the developing means 4, latent image-bearing member 1, cleaning means 6, and primary charging means 2. However, the cartridge according to the present invention requires at least two members of developing means and latent image-bearing member to be integrated. Accordingly, the cartridge can also be composed of three members of developing means, a latent image-bearing member and cleaning means; three members of developing means, latent image-bearing member and primary means; or three or more members including another member in addition to the developing means and the latent image-bearing member.

Turning back to FIG. 6, in an image forming apparatus, such as a copying machine or a printer, the image light L may be given as reflected light or transmitted light from an original, or by reading an original to form signals and driving a laser, an LED array or a liquid crystal shutter array based on the signals to form a scanning laser beam or signal light.

Figure 8:
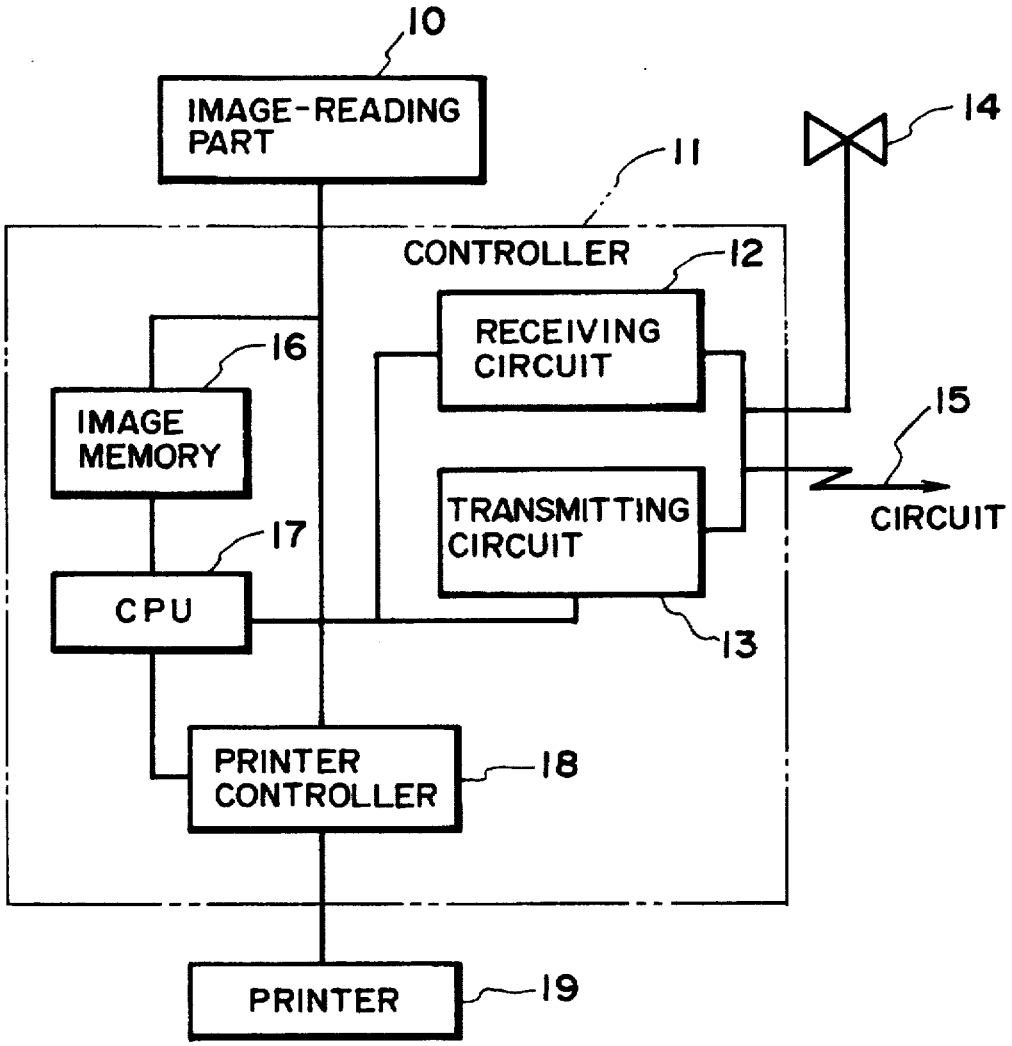
FIG. 8 is a block diagram for illustrating a printer for a facsimile apparatus to which the present invention is applicable.

In case where the image forming apparatus according to the present invention is used as a printer for facsimile, the image light L (as shown in FIG. 6) may be replaced by exposure light image for printing received data. FIG. 8 is a block diagram for illustrating such an embodiment.

Referring to FIG. 8, a controller 11 controls an image reader (or image reading unit) 10 and a printer 19. The entirety of the controller 11 is regulated by a CPU 17. Data read from the image reader 10 is transmitted through a transmitter circuit 13 to a remote terminal such as another facsimile machine. On the other hand, data received from a remote terminal is transmitted through a receiver circuit 12 to a printer 19. An image memory 16 stores prescribed image data. A printer controller 18 controls the printer 19. A telephone handset 14 is connected to the receiver circuit 12 and the transmitter circuit 13.

More specifically, an image received from a line (or circuit) 15 (i.e., image data received from a remote terminal connected by the line) is demodulated by means of the receiver circuit 12, decoded by the CPU 17, and sequentially stored in the image memory 16. When image data corresponding to at least one page is stored in the image memory 16, image recording or output is effected with respect to the corresponding page. The CPU 17 reads image data corresponding to one page from the image memory 16, and transmits the decoded data corresponding to one page to the printer controller 18. When the printer controller 18 receives the image data corresponding to one page from the CPU 17, the printer controller 18 controls the printer 19 so that image data recording corresponding to the page is effected. During the recording by the printer 19, the CPU 17 receives another image data corresponding to the next page.

Thus, receiving and recording of an image may be effected by means of the apparatus shown in FIG. 8 in the above-mentioned manner.

As described above, the toner according to the present invention is characterized by satisfying the conditions (i) (a specific particle size distribution), (ii) (a specific thermal characteristic) and (iii) (a specific tap void), and the toner is effective in suppressing the increase of a fine toner fraction at a non-image part on a toner-carrying member, so that the sleeve ghost is suppressed to provide high quality toner images.

Hereinbelow, the present invention will be described more specifically based on Examples, wherein "part(s)" means "part(s) by weight".

EXAMPLE 1

| | |
|---|---|
| Styrene-n-butyl acrylate-monobutyl maleate copolymer (AV (acid value) = 5.2, Tg = 60° C.) | 100 parts |
| Magnetic iron oxide (Almost spherical (LA/SA (long axis/short axis ratio) = 1.05, Si (silicon) content = 0.7 wt. %) | 120 parts |
| Higher aliphatic alcohol (MP (melting point) = 106° C.) | 5 parts |
| Monoazo iron complex (of the formula below) | 4 parts |

-continued

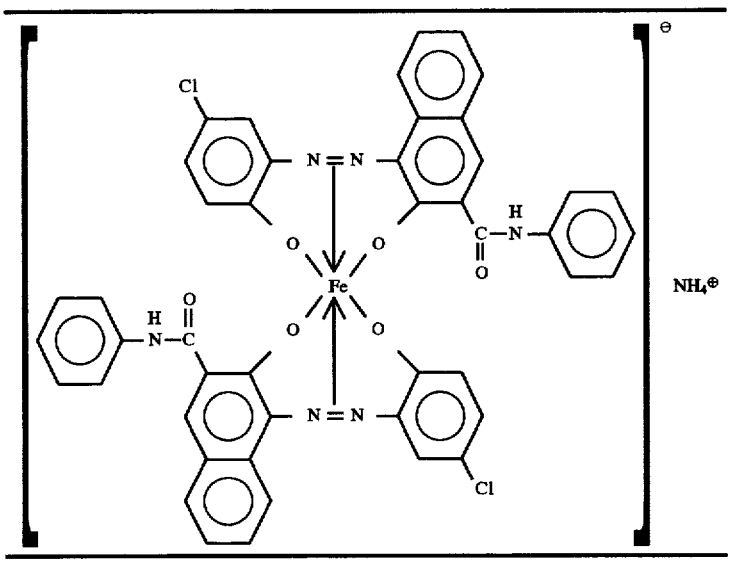

The above ingredients were preliminarily blended and melt kneaded through a twin-screw kneading extruder set at 130° C. After cooling, the kneaded product was coarsely crushed and then finely pulverized by a pulverizer using a jet air stream, followed by classification by means of a pneumatic classifier to obtain magnetic toner particles (black fine powder).

Separately, 10 parts of dimethylsilicone oil (viscosity: 50 cSt at 25° C.) diluted with n-hexane into four times of amount was sprayed onto 100 parts of hydrophobized (i.e., hydrophobicity-imparted) silica ($S_{BET}$ (BET specific surface area)=300 $m^2/g$) (synthesized by the dry process and then hydrophobized with 20 parts of hexamethyldisilazane (HMDS)) under stirring and, after the completion of the spraying, the treated silica was heated to 300° C. in a nitrogen gas atmosphere and retained at the temperature for 50 min. under stirring to obtain Treated silica 1 (treated with dimethylsilicone oil) having a pH of 5.7.

To 100 parts of the above-prepared black fine powder, 1.5 parts of Treated silica 1 was added thereto, followed by blending to obtain Toner 1.

The particle size distribution of Toner 1 was measured by a Coulter Multisizer (available Coulter Electronics Inc.), and the data was converted into data for 16 channels (shown in Table 1 below) whereby a particle size distribution as shown in Table 1 was determined. As a result, Toner 1 showed a weight-average particle size ($D_4$) of 5.69 μm, 5.6% by number of particles of at most 2.52 μm (N (≧2.52 μm) %), 16.7% by number of at most 3.17 μm (N (≦3.17 μm) %) and 66.9% by number of particles of at most 5.04 μm (N (≦5.04 μm) %). Further, Toner 1 showed a tap void (TV) of 0.57.

TABLE 1

| | | Distribution | | | |
|---|---|---|---|---|---|
| | | | | volume-basis | |
| | | number-basis | | | cumula- |
| Size (μm) | Number (–) | fractional (%) | cumulation (%) | fractional (%) | tion (%) |
| 1.59–2.00 | 0 | 0 | 0 | 0 | 0 |
| 2.00–2.52 | 2793 | 5.6 | 5.6 | 0.6 | 0.6 |
| 2.52–3.17 | 5543 | 11.1 | 16.7 | 2.3 | 2.9 |
| 3.17–4.00 | 10361 | 20.7 | 37.4 | 8.5 | 11.3 |
| 4.00–5.04 | 14756 | 29.5 | 66.9 | 23.6 | 34.9 |
| 5.04–6.35 | 12045 | 24.1 | 91 | 36.8 | 71.7 |
| 6.35–8.00 | 4044 | 8.1 | 99.1 | 23.2 | 94.9 |
| 8.00–10.08 | 449 | 0.9 | 100 | 4.9 | 99.8 |
| 10.08–12.70 | 9 | 0 | 100 | 0.2 | 100 |
| 12.70–16.00 | 0 | 0 | 100 | 0 | 100 |
| 16.00–20.20 | 0 | 0 | 100 | 0 | 100 |
| 20.20–25.40 | 0 | 0 | 100 | 0 | 100 |
| 25.40–32.00 | 0 | 0 | 100 | 0 | 100 |
| 32.00–40.30 | 0 | 0 | 100 | 0 | 100 |
| 40.30–50.80 | 0 | 0 | 100 | 0 | 100 |
| 50.80–64.00 | 0 | 0 | 100 | 0 | 100 |

Figure 3:
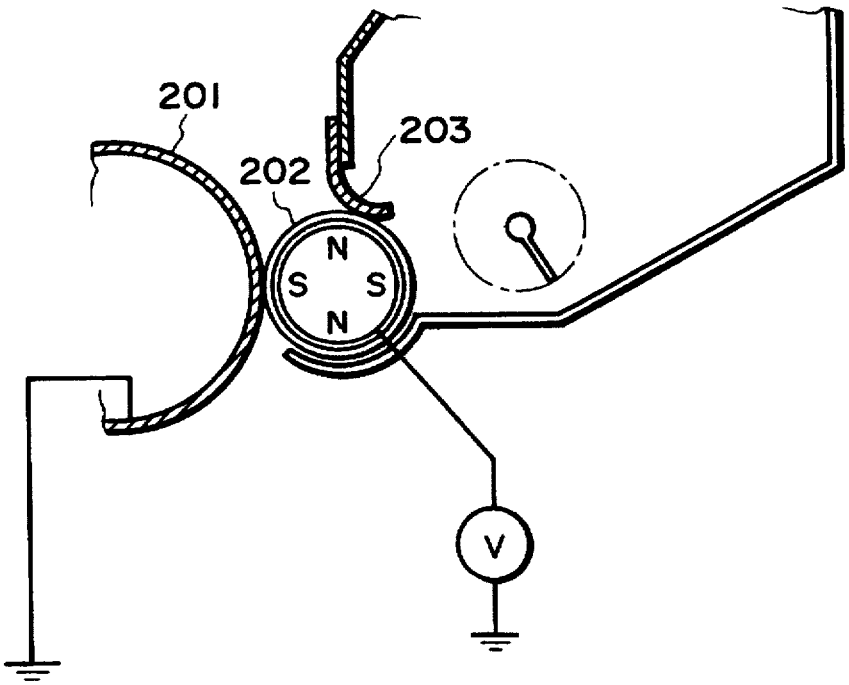
FIGS. 3 and 4 are schematic views each illustrating an embodiment of the developing device according to the present invention using an elastic blade.
Figure 4:
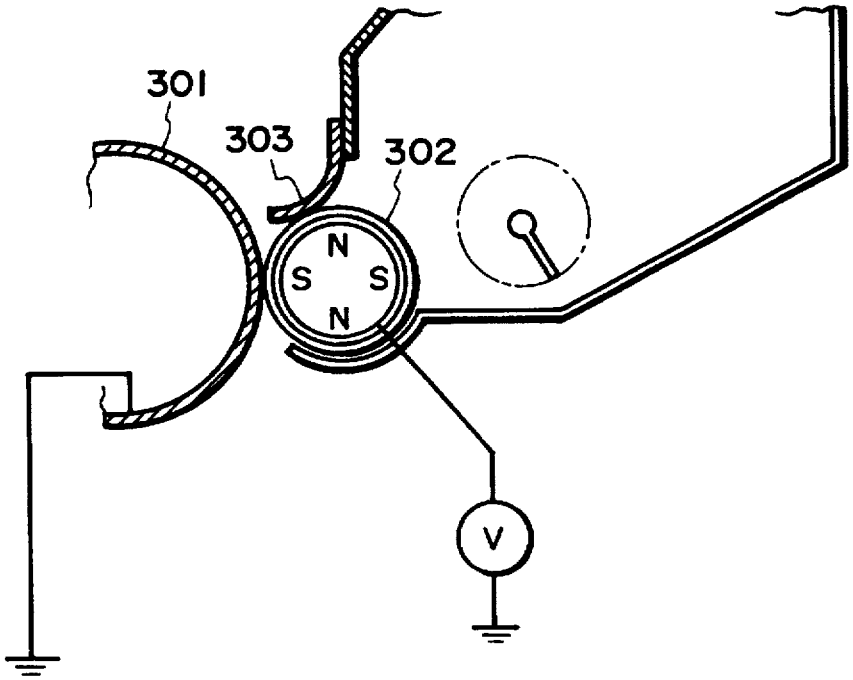

The above-prepared Toner 1 was evaluated by using an image forming apparatus having a structure as roughly shown in FIG. 6 and including a developing device as shown in FIG. 3.

More specifically, a toner-carrying member (Sleeve 1 (resin-coated), 202 in FIG. 6) was prepared by blasting an aluminum cylinder (outer diameter=16 mm) with indefinite-shaped abrasive and coating the blasted cylinder with a resin coating layer comprising 1 part of carbon black and 9 parts of graphite dispersed in 10 parts of phenolic resin. A four-pole magnet having a developing pole exerting a magnetic flux density of 75 mT (750 Gauss) was installed with the cylindrical sleeve.

A urethane rubber blade (203) as a toner layer thickness-regulating member was abutted at a linear pressure of 19.6 N/m (20 g/cm) against the sleeve (202) as shown in FIG. 3.

The photosensitive member was a 30 mm-dia. photosensitive drum of an organic photoconductor-type.

The primary charger (2 in FIG. 6) was a roller charger of the contact charging-type, and the exposure was performed by using laser light to form a latent image at 600 dpi. The transfer charger (5) was a roller charger of the contact charging-type.

The cleaning device (6) was a blade cleaning device including a urethane rubber blade as a cleaning blade.

The charging and exposure conditions were set to provide a latent image with a dark-part potential of −700 volts and a light-part potential of −150 volts on the photosensitive member.

The photosensitive member and the toner-carrying member were both rotated at a peripheral speed of 72 mm/sec.

The toner-carrying member was supplied with a developing bias of a rectangular wave comprising a DC voltage of −500 volts and an AC voltage of 1600 volts (peak-to-peak) and an AC frequency of 1800 Hz.

Toner 1 (as a mono-component developer) was evaluated by using the above-mentioned image forming apparatus for 1000 sheets of image formation in an environment of 15° C./10% RH, whereby the resultant images were evaluated with respect to image density, fog, sleeve ghost, and overall image quality and image uniformity.

Image density (ID)

was measured as a reflection density of a solid black image by using a Macbeth reflection densitometer (available from Macbeth Co.).

Fog was evaluated as a difference in whiteness between a yet-unused transfer paper and a transfer paper after printing of a solid white image as measured by using a reflectometer (available from Tokyo Denshoku K.K.).

Sleeve ghost (SG)

was evaluated as follows. In an environment of 15° C./10% RH, a solid white image was continuously formed on 10 sheets and, immediately thereafter, a subsequent sheet was printed with an image pattern as shown in FIG. 9 having alternating stripes of solid black print portion (B) and solid white print portion (W) for a length of one photosensitive drum circumference, followed by a whole-area uniform halftone image portion. Then, the image density ($ID_{B'}$) at a halftone image portion B' subsequent to the solid black stripe portion (B) and the image density ($ID_{A'}$) at a halftone image portion A' subsequent to the solid white stripe portion (A) were measured. The sleeve ghost (SG) was evaluated in terms of an image density difference ($ID_{B'}-ID_{A'}$).

Figure 10:
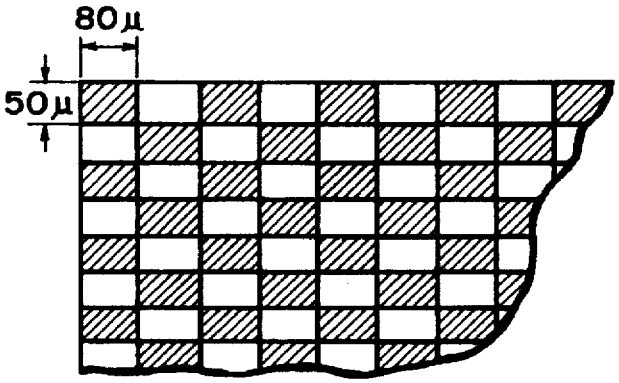
FIG. 10 is a partial illustration of an image pattern for evaluating dot reproducibility.

Dot reproducibility (Dot)

was evaluated as an item of image quality evaluation by the reproducibility of a checker pattern as shown in FIG. 10 including 100 unit square dots each measuring 80 μm×50 μm, by observation through a microscope while noticing the clearness of the image, particularly scattering to the non-image parts, and the number of defects (lack) of black dots. The symbols denote the following results:

⊙: less than 2 defects/100 dots

○: 3–5 defects

Δ: 6–10 defects x: 11 or more defects.

The image uniformity evaluation was performed by evaluating the uniformity of the solid black images formed for image density measurement at the initial stage of image formation. (The result is noted in Table 2 only for a toner giving a noticeably inferior result.)

The results of the evaluation are inclusively shown in Table 2 appearing hereinafter together with those obtained in other Examples and Comparative Examples.

Comparative Example 1

| | |
|---|---|
| Styrene-n-butyl acrylate-monobutyl maleate copolymer (AV = 20, Tg = 60° C.) | 100 parts |
| Magnetic iron oxide (octahedral, LA/SA = 1.4) | 90 parts |
| Low-molecular weight polyethylene (MP = 130° C.) | 5 parts |
| Salicylic acid chromium complex | 2 parts |

Black fine powder (toner particles) was prepared in the same manner as in Example 1 except for using the above ingredients.

To 100 parts of the black fine powder, 1.2 parts of Treated silica 1 (treated with dimethylsilicone oil) prepared in Example 1 was added and blended therewith by a Henschel mixer to obtain Toner 2, which was evaluated in the same manner as in Example 1.

Toner 2 showed $D_4$=7.5 μm., N (≦2.52 μm) %=1.3%, N (≦3.17 μ) %=5.2%, N (≦5.04 μm) %=40.5%, and TV=0.41.

EXAMPLES 2–12 AND COMPARATIVE EXAMPLES 2–6

Toners were prepared in similar manners as in Example 1 except for changing the particle sizes and waxes as shown in Table 2. The toners were evaluated for image forming performances in the same manner as in Example 1. The results are also shown in Table 2.

EXAMPLES 13–16

Toners were prepared in the same manner as in Example 1 except for using binder resins having different acid values (AV) as shown in Table 3 and evaluated in the same manner as in Example 1.

The results are also shown in Table 3.

TABLE 2

| | Toner | | | | | Wax | | Toner | | | Image density | | Fog at 1000 | |
|---|---|---|---|---|---|---|---|---|---|---|---|---|---|---|
| Example | $D_4$ (μm) | N (≦2.52 μm) (%) | N (≦3.17 μm) (%) | N (≦5.04 μm) (%) | Species*2 | MP (°C.) | Amount (parts) | DSC peak (°C.) | Tap void (−) | Sleeve ghost | Initial | At 1000 sheets | sheets (%) | Dot |
| Ex. | | | | | | | | | | | | | | |
| 1 | 5.69 | 4.0 | 16.7 | 67.1 | HAA | 106 | 5 | 105 | 0.57 | 0.01 | 1.47 | 1.45 | 1.8 | ○ |
| 2 | 4.92 | 12.5 | 24.1 | 83.7 | HAA | 106 | 5 | 105 | 0.59 | 0.03 | 1.45 | 1.40 | 2.5 | ⊙ |
| 3 | 5.42 | 5.6 | 17.1 | 68.9 | HAA | 106 | 5 | 105 | 0.58 | 0.03 | 1.47 | 1.42 | 2.0 | ○ |

TABLE 2-continued

| Example | Toner $D_4$ (μm) | Toner N (≦2.52 μm) (%) | Toner N (≦3.17 μm) (%) | Toner N (≦5.04 μm) (%) | Wax Species*2 | Wax MP (°C.) | Wax Amount (parts) | Toner DSC peak (°C.) | Toner Tap void (–) | Sleeve ghost | Image density Initial | Image density At 1000 sheets | Fog at 1000 sheets (%) | Dot |
|---|---|---|---|---|---|---|---|---|---|---|---|---|---|---|
| 4 | 5.73 | 2.6 | 6.5 | 62.4 | HAA | 106 | 5 | 105 | 0.56 | 0.01 | 1.48 | 1.45 | 1.7 | ○ |
| 5 | 6.21 | 3.5 | 14.3 | 63.2 | HAA | 106 | 5 | 105 | 0.53 | 0.02 | 1.48 | 1.44 | 1.5 | ○ |
| 6 | 6.41 | 2.0 | 6.7 | 62.7 | HAA | 106 | 5 | 105 | 0.52 | 0.03 | 1.48 | 1.46 | 1.3 | Δ |
| 7 | 5.02 | 9.8 | 12.0 | 72.8 | HAA | 106 | 5 | 105 | 0.58 | 0.01 | 1.46 | 1.44 | 1.9 | ⊙ |
| 8 | 6.39 | 3.5 | 17.7 | 63.5 | HAA | 106 | 5 | 105 | 0.55 | 0.03 | 1.48 | 1.43 | 1.7 | Δ |
| 9 | 6.02 | 6.1 | 24.2 | 64.3 | HAA | 106 | 5 | 105 | 0.56 | 0.06 | 1.46 | 1.42 | 2.1 | ○ |
| 10 | 5.37 | 3.4 | 9.6 | 59.8 | HAA | 106 | 5 | 105 | 0.57 | 0.08 | 1.46 | 1.43 | 2.0 | ○ |
| 11 | 5.63 | 3.8 | 16.2 | 66.5 | CW | 82 | 5 | 82 | 0.57 | 0.01 | 1.48 | 1.42 | 1.7 | ○ |
| 12 | 5.66 | 3.5 | 18.3 | 68.1 | CW | 82 | 3 | 82 & | 0.58 | 0.02 | 1.47 | 1.43 | 1.8 | ○ |
| | | | | | LMWPPW | 130 | 4 | 130 | | | | | | |
| Comp. Ex. | | | | | | | | | | | | | | |
| 1 | 7.51 | 1.3 | 5.2 | 40.5 | LMWPPW | 130 | 4 | 130 | 0.41 | 0.18 | 1.42 | 1.35 | 1.6 | x |
| 2 | 5.63 | 19.5 | 42.8 | 70.1 | HAA | 106 | 5 | 105 | 0.54 | 0.13 | 1.40 | 1.32 | 3.7 | ○ |
| 3*1 | 5.11 | 2.1 | 6.8 | 66.1 | HAA | 106 | 5 | 105 | 0.56 | 0.01 | 1.46 | 1.44 | 1.6 | Δ |
| 4 | 5.56 | 4.6 | 18.1 | 68.7 | LMWPPW | 130 | 4 | 130 | 0.42 | 0.10 | 1.47 | 1.44 | 1.7 | ○ |
| 5 | 6.82 | 1.8 | 5.8 | 43.0 | HAA | 106 | 5 | 105 | 0.42 | 0.14 | 1.43 | 1.40 | 1.8 | x |
| 6 | 5.64 | 7.1 | 24.3 | 76.0 | LMWPPW | 130 | 5 | 130 | 0.44 | 0.10 | 1.46 | 1.38 | 2.2 | ○ |

*1Images at the initial stage were accompanied with ripple-like irregularity attributable to the toner coating irregularity on the developing sleeve.
*2HAA = higher fatty alcohol, CW = carnauba wax, and LMWPPW = low-molecular weight polypropylene wax.

TABLE 3

| Example | $D_4$ (μm) | N (≦2.52 μm) (%) | N (≦3.17 μm) (%) | N (≦5.04 μm) (%) | DSC peak (°C.) | Tap void (–) | AV of binder (mg KOH/g) | Sleeve ghost | Image density Initial | Image density at 1000 sheets | Fog at 1000 sheets (%) | Dot |
|---|---|---|---|---|---|---|---|---|---|---|---|---|
| Ex. | | | | | | | | | | | | |
| 13 | 5.64 | 3.5 | 15.9 | 66.8 | 105 | 0.55 | 3.1 | 0.01 | 1.48 | 1.45 | 1.7 | ○ |
| 14 | 5.77 | 3.8 | 17.3 | 66.2 | 105 | 0.55 | 10 | 0.02 | 1.47 | 1.42 | 2.0 | ○ |
| 15 | 5.72 | 3.6 | 16.2 | 67.3 | 105 | 0.54 | 20 | 0.03 | 1.47 | 1.41 | 2.2 | ○ |
| 16 | 5.68 | 3.7 | 15.8 | 66.2 | 105 | 0.55 | 38 | 0.03 | 1.44 | 1.38 | 2.4 | ○ |

EXAMPLES 17–19

Toners having particle size distributions shown in Table 4 were prepared in a similar manner as in Example 1 except for using charge control agents (CC agent) shown in Table 4 and evaluated in the same manner as in Example 1.

The toners were further subjected to image forming performance in an high temperature/high humidity environment by using the same image forming apparatus as in Example 1. More specifically, the toners were used for image formation on 2000 sheets in an environment of 32.5° C./85% RH. Then, the image forming apparatus containing each toner was left standing in the environment for 1 day and the image density of the images formed thereafter was measured.

The results are shown in Table 4.

TABLE 4

| Example | $D_4$ (μm) | N (≦2.5 μm) (%) | N (≦3.17 μm) (%) | N (≦5.04 μm) (%) | DSC peak (°C.) | Tap void (–) | CC*1 agent (parts) | Sleeve ghost | Image density Initial | Image density at 1000 sheets | Fog at 1000 sheets (%) | Dot | Image density 32.5° C. 85% RH |
|---|---|---|---|---|---|---|---|---|---|---|---|---|---|
| Ex. 17 | 5.74 | 3.6 | 16.0 | 67.0 | 105 | 0.56 | MAIC (2) | 0.03 | 1.47 | 1.40 | 2.1 | ○ | 1.35 |
| Ex. 18 | 5.78 | 3.8 | 17.2 | 68.1 | 105 | 0.56 | MACC (0.5) | 0.06 | 1.46 | 1.38 | 2.4 | ○ | 1.36 |

TABLE 4-continued

| Example | $D_4$ (μm) | N (≦2.5 μm) (%) | N (≦3.17 μm) (%) | N (≦5.04 μm) (%) | DSC peak (°C.) | Tap void (–) | CC*1 agent (parts) | Sleeve ghost | Image density Initial | Image density at 1000 sheets | Fog at 1000 sheets (%) | Dot | Image density 32.5° C. 85% RH |
|---|---|---|---|---|---|---|---|---|---|---|---|---|---|
| Ex. 19 | 5.62 | 4.0 | 18.0 | 68.8 | 105 | 0.57 | NACC (2) | 0.06 | 1.42 | 1.36 | 2.5 | ○ | 1.20 |

*1MAIC: monoazo iron complex
MACC: monoazo chromium complex
NACC: naphthoic acid iron complex

EXAMPLES 20–27

Toners having particle size distributions shown in Table 5 were prepared in the same manner as in Example 1 except for using magnetic materials having particle shapes and silicon or aluminum contents shown in Table 5 and evaluated in the same manner as in Example 1.

Further, the toners were evaluated with respect to the image densities in a high temperature/high humidity environment in the same manner as in Examples 17–19.

The results are also shown in Table 5.

EXAMPLE 31 AND COMPARATIVE EXAMPLES 7 AND 8

Toners were prepared in the same manner as in Example 30 except for replacing Treated silica 1 with Treated silica 4–6 prepared in the following manner and evaluated in the same manner as in Example 30. The results are shown in Table 6.

[Treated silica 4 (with dimethylsilicone oil)]

20 parts of dimethylsilicone oil (DMSO) (viscosity at 25° C.=50 cSt) was diluted with n-hexane into four times of amount, and sprayed onto 100 parts of dry process silica ($S_{BET}$=300 $m^2/g$), followed by heating to 300° C. in a nitrogen gas atmosphere and stirring for 50 min. to obtain Treated silica 4.

[Treated silica 5 (with dimethylsilane coupling agent)]

20 parts of dimethylsilane coupling agent (DMSCA) was diluted with n-hexane into four times of amount, and sprayed onto 100 parts of dry process silica ($S_{BET}$=300 $m^2/g$), followed by heating to 300° C. in a nitrogen gas atmosphere and stirring for 50 min. to obtain Treated silica 5.

[Treated silica 6 (with dimethylsilicone oil)]

10 parts of dimethylsilicone oil (DMSO) (viscosity at 25° C.=50 cSt) was diluted with n-hexane into four times of amount, and sprayed onto 100 parts of dry process silica ($S_{BET}$=300 $m^2/g$), followed by heating to 300° C. in a nitrogen gas atmosphere and stirring for 50 min. to obtain Treated silica 6.

TABLE 5

| Example | $D_4$ (μm) | N (≦2.52 μm) (%) | N (≦3.17 μm) (%) | N (≦5.04 μm) (%) | DSC peak (°C.) | Tap void (–) | Magnetic material shape*1 (LA/SA) | Magnetic material Si or Al content (wt. %) | Sleeve ghost | Image density Initial | Image density At 1000 sheets | Fog at 1000 sheets (%) | Dot | Image density 32.5° C. 85% RH |
|---|---|---|---|---|---|---|---|---|---|---|---|---|---|---|
| Ex. 20 | 5.71 | 3.7 | 17.2 | 65.8 | 105 | 0.56 | AS (1.04) | Al (0.5) | 0.02 | 1.47 | 1.42 | 2.0 | ○ | 1.36 |
| Ex. 21 | 5.64 | 3.4 | 18.0 | 68.1 | 105 | 0.55 | OH (1.37) | — | 0.06 | 1.45 | 1.37 | 1.8 | ○ | 1.25 |
| Ex. 22 | 5.69 | 3.5 | 16.7 | 66.7 | 105 | 0.55 | AS (1.05) | — | 0.04 | 1.45 | 1.40 | 2.4 | ○ | 1.38 |
| Ex. 23 | 5.75 | 3.5 | 16.8 | 65.2 | 105 | 0.56 | OH (1.40) | Al (0.7) | 0.05 | 1.45 | 1.36 | 1.8 | ○ | 1.24 |
| Ex. 24 | 5.70 | 3.7 | 17.5 | 65.8 | 105 | 0.55 | OH (1.38) | Si (1.1) | 0.05 | 1.44 | 1.38 | 1.7 | ○ | 1.26 |
| Ex. 25 | 5.66 | 3.9 | 17.1 | 66.5 | 105 | 0.55 | AS (1.07) | Al (2.4) | 0.01 | 1.46 | 1.43 | 1.6 | ○ | 1.30 |
| Ex. 26 | 5.73 | 3.8 | 17.7 | 65.3 | 105 | 0.55 | AS (1.06) | Si (1.0) | 0.01 | 1.47 | 1.42 | 1.8 | ○ | 1.36 |
| Ex. 27 | 5.59 | 4.2 | 18.6 | 69.5 | 105 | 0.57 | AS (1.08) | Si (4.1) | 0.01 | 1.47 | 1.43 | 1.6 | ○ | 1.28 |

*1As: almost spherical, OH: octahedral.

EXAMPLES 28–29

Toners having particle size distributions shown in Table 6 were prepared in the same manner as in Example 1 except for replacing Treated silica 1 (pH 5.7) (treated with dimethylsilicone oil) with Treated silica 2 (pH 6.1) or Treated silica 3 (pH 8.1) (respectively prepared under different conditions and treated with dimethylsilicone oil (DMSO)), and evaluated in the same manner as in Example 1. The results are shown in Table 6.

EXAMPLE 30

A toner (containing Treated silica 1) identical to the toner prepared in Example 1 except for its particle size distribution shown in Table 6 was prepared and evaluated in the same manner as in Example 1. The results are shown in Table 6.

TABLE 6

| Example | $D_4$ (μm) | N (≦2.52 μm) (%) | N (≦3.17 μm) (%) | N (≦5.04 μm) (%) | DSC peak (°C.) | Tap void (–) | Treated silica | Sleeve ghost | Image density Initial | Image density at 1000 sheets | Fog at 1000 sheets (%) | Dot |
|---|---|---|---|---|---|---|---|---|---|---|---|---|
| Ex. 28 | 5.69 | 4.0 | 16.7 | 67.1 | 105 | 0.57 | 2 (DMSQ) (ph = 6.1) | 0.02 | 1.47 | 1.42 | 2.1 | ○ |
| Ex. 29 | 5.69 | 4.0 | 16.7 | 67.1 | 105 | 0.57 | 3 (DMSO) (pH = 8.1) | 0.04 | 1.45 | 1.39 | 2.3 | ○ |
| Ex. 30 | 6.43 | 1.7 | 5.9 | 62.3 | 105 | 0.51 | 1 (DMSO) (pH = 5.7) | 0.03 | 1.48 | 1.45 | 1.2 | ○ |
| Ex. 31 | 6.43 | 1.7 | 5.9 | 62.3 | 105 | 0.48 | 4 (DMSO) (pH = 5.3) | 0.05 | 1.47 | 1.45 | 1.5 | ○ |
| Comp. Ex. 7 | 6.43 | 1.7 | 5.9 | 62.3 | 105 | 0.42 | 5 (DMSCA) (pH = 5.4) | 0.08 | 1.40 | 1.28 | 1.5 | Δ |
| Comp. Ex. 8 | 6.43 | 1.7 | 5.9 | 62.3 | 105 | 0.43 | 6 (DMSO) (pH = 5.2) | 0.11 | 1.43 | 1.37 | 1.6 | ○ |

EXAMPLES 30–31

The toner of Example 1 was evaluated in the same manner as in Example 1 except for replacing Sleeve 1 (resin-coated) in the image forming apparatus used in Example 1 with Sleeves 2 (Example 30) and 3 (Example 31), respectively, prepared in the following manner. The results are Shown in Table 7.

[Sleeve 2 (resin-coated)]

Sleeve 2 was identical to Sleeve 1 except that the resin coating layer comprised 1 part of carbon black and 7 parts of graphite dispersed in 10 parts of phenolic resin.

[Sleeve 3 (blasted only)]

A starting aluminum sleeve used in Example 1 was treated only by blasting with alundum(#400) particles.

EXAMPLES 32 AND 33

The toner of Example 1 was evaluated in the same manner as in Example 1 except that the urethane rubber blade was abutted at a higher linear pressure of 29.4 N/m (30 g/cm) (Example 32) or the urethane rubber blade was replaced by a magnetic blade disposed with a gap of 200 μm from the developing sleeve (Example 33). The results are shown in Table 8.

TABLE 7

| Example | $D_4$ (μm) | N (≦2.52 μm) (%) | N (≦3.17 μm) (%) | N (≦5.04 μm) (%) | DSC peak (°C.) | Tap void (–) | Sleeve | Sleeve ghost | Image density Initial | Image density at 1000 sheets | Fog at 1000 sheets (%) | Dot |
|---|---|---|---|---|---|---|---|---|---|---|---|---|
| Ex. 30 | 5.69 | 4.0 | 16.7 | 67.1 | 105 | 0.57 | 2 (resin-coated) | 0.01 | 1.48 | 1.44 | 1.9 | ○ |
| Ex. 31 | 5.68 | 4.0 | 16.7 | 67.1 | 105 | 0.57 | 3 (blasted only) | 0.07 | 1.47 | 1.38 | 1.7 | ○ |

TABLE 8

| Example | $D_4$ (μm) | N (≦2.52 μm) (%) | N (≦3.17 μm) (%) | N (≦5.04 μm) (%) | DSC peak (°C.) | Tap void (–) | Regulating blade | Sleeve ghost | Image density Initial | Image density at 1000 sheets | Fog at 1000 sheets (%) | Dot |
|---|---|---|---|---|---|---|---|---|---|---|---|---|
| Ex. 32 | 5.69 | 4.0 | 16.7 | 67.1 | 105 | 0.57 | rubber blade | 0.02 | 1.45 | 1.43 | 2.0 | ○ |
| Ex. 33 | 5.69 | 4.0 | 16.7 | 67.1 | 105 | 0.57 | magnetic blade | 0.07 | 1.44 | 1.35 | 2.3 | x |

What is claimed is:

1. A toner for developing electrostatic images, comprising: toner particles comprising a binder resin, a colorant and a wax; wherein the toner has:

(i) a particle size distribution including a weight-average particle size $D_4$ of X μm and Y% by number of toner particles having a particle size of at most 3.17 μm satisfying the following conditions (1) and (2):

$$-5X+35 \leqq Y \leqq -25X+180 \quad (1)$$

$$>4.0 \leqq X \leqq 6.3 \quad (2),$$

(ii) at least one heat absorption peak in a temperature region of at most 110° C. as measured by differential thermal analysis, and (iii) a tap void of 0.45–0.70.

2. The toner according to claim 1, wherein the toner further satisfies the following condition (3):

$$-5X+35 \leqq Y \leqq -12.5X+98.75 \quad (3).$$

3. The toner according to claim 1, wherein the toner has a weight-average particle size $D_4$ of X μm and contains Z% by number of toner particles having a particle size of at most 2.52 μm satisfying the following condition (5).

$$-7.5X+45 \leqq Z \leqq -12.0X+82 \quad (5).$$

4. The toner according to claim 1, wherein the toner contains at least 62% by number of toner particles having a particle size of at most 5.04 μm.

5. The toner according to claim 1, wherein the toner contains 62–95% by number of toner particles having a particle size of at most 5.04 μm.

6. The toner according to claim 1, wherein the toner has at least one heat absorption peak in a temperature region of 60°–110° C. as measured by differential thermal analysis.

7. The toner according to claim 1, wherein the toner contains a low-melting point substance having at least one heat absorption peak in a temperature region of at most 110° C. as measured by differential thermal analysis.

8. The toner according to claim 1, wherein the toner contains a low-melting point substance having at least one heat absorption peak in a temperature region of 60°–110° C. as measured by differential thermal analysis.

9. The toner according to claim 7, wherein the low-melting point substance comprises a resin.

10. The toner according to claim 7, wherein the low-melting point substance comprises a wax.

11. The toner according to claim 1, wherein the toner has a tap void of 0.50–0.70.

12. The toner according to claim 1, wherein the toner has a tap void of 0.50–0.60.

13. The toner according to claim 1, wherein the binder resin has an acid value of at least 15 mgKOH/g.

14. The toner according to claim 1, wherein the toner particles contain an azo metal complex.

15. The toner according to claim 1, wherein the azo metal complex has iron as its central metal.

16. The toner according to claim 1, wherein the toner particles contain a magnetic material.

17. The toner according to claim 16, wherein the magnetic material comprises magnetic iron oxide containing silicon or aluminum.

18. The toner according to claim 17, wherein the magnetic iron oxide contains 0.1–3 wt. % of silicon based on iron.

19. The toner according to claim 17, wherein the magnetic iron oxide contains 0.1–2 wt. % of aluminum based on iron.

20. The toner according to claim 16, wherein the magnetic material comprises particles having an average long axis/short axis ratio in the range of 1.0–1.2.

21. The toner according to claim 1, wherein the toner comprises the toner particles and silicone oil-treated inorganic fine powder.

22. The toner according to claim 21, wherein the silicone oil-treated inorganic fine powder has a pH of at most 7.0.

23. The toner according to claim 1, wherein the toner has been obtained through steps of melt-kneading the binder resin, the colorant and a low-melting point substance to form a melt-kneaded product, and pulverizing the melt-kneaded product.

24. An image forming method, comprising:

electrically charging an image-bearing member, forming an electrostatic image on the image-bearing member, and developing the electrostatic image with a toner carried on a toner-carrying member to form a toner image on the image-bearing member;

wherein the toner comprises toner particles comprising a binder resin, a colorant and a wax, and has (i) a particle size distribution including a weight-average particle size $D_4$ of X μm and Y% by number of toner particles having a particle size of at most 3.17 μm satisfying the following conditions (1) and (2):

$$-5X+35 \leqq Y \leqq -25X+180 \quad (1)$$

$$>4.0 \leqq X \leqq 6.3 \quad (2),$$

(ii) at least one heat absorption peak in a temperature region of at most 110° C. as measured by differential thermal analysis, and (iii) a tap void of 0.45–0.70.

25. The method according to claim 24, wherein the image-bearing member comprises an electrophotographic photosensitive member.

26. The method according to claim 24, wherein a layer of the toner is formed on the toner-carrying member by a toner layer thickness-regulating member.

27. The method according to claim 26, wherein the toner layer thickness-regulating member comprises an elastic blade abutted to the toner-carrying member.

28. The method according to claim 27, wherein the elastic blade is formed of a member selected from the group consisting of elastomers, elastic synthetic resins, elastic metals and composites of these materials.

29. The method according to claim 24, wherein the toner-carrying member comprises an electroconductive sleeve, and a resin coating layer containing electroconductive particles and formed on the electroconductive sleeve.

30. The method according to claim 24, wherein the toner is carried on the toner-carrying member in a layer having a thickness which is smaller than a gap formed between the image-bearing member and the toner-carrying member.

31. The method according to claim 24, wherein the toner-carrying member comprises a sleeve containing a magnet.

32. The method according to claim 24, wherein the toner is a toner according to any one of claims 2 or 4–24.

33. A developing device, comprising:

a toner comprising toner particles comprising a binder resin, a colorant and a wax, a toner vessel containing the toner, and a toner-carrying member for carrying and conveying the toner contained in the toner vessel to a developing position, wherein the toner has:

(i) a particle size distribution including a weight-average particle size $D_4$ of X μm and Y% by number of toner particles having a particle size of at most 3.17 μm satisfying the following conditions (1) and (2):

$$-5X+35 \leqq Y \leqq -25X+180 \quad (1)$$

$$>4.0 \leqq X \leqq 6.3 \quad (2),$$

(ii) at least one heat absorption peak in a temperature region of at most 110° C. as measured by differential thermal analysis, and (iii) a tap void of 0.45–0.70.

34. The developing device according to claim 33, wherein a layer of the toner is formed on the toner-carrying member by a toner layer thickness-regulating member.

35. The developing device according to claim 34, wherein the toner layer thickness-regulating member comprises an elastic blade abutted to the toner-carrying member.

36. The developing device according to claim 35, wherein the elastic blade is formed of a member selected from the group consisting of elastomers, elastic synthetic resins, elastic metals and composites of these materials.

37. The developing device according to claim 33, wherein the toner-carrying member comprises an electroconductive sleeve, and a resin coating layer containing electroconductive particles and formed on the electroconductive sleeve.

38. The developing device according to claim 33, wherein the toner-carrying member comprises a sleeve containing a magnet.

39. The developing device according to claim 33, wherein the toner is a toner according to any one of claims 2 or 3–23.

40. A process cartridge detachably mountable to a main body of an image forming apparatus, comprising:

an image-bearing member for holding an electrostatic image, and a developing means for developing an electrostatic image held on the image-bearing member to form a toner image on the image-bearing member;

wherein the developing means comprises a toner comprising toner particles comprising a binder resin, a colorant and a wax, a toner vessel containing the toner, and a toner-carrying member for carrying and conveying the toner contained in the toner vessel to a developing position, wherein the toner has:

(i) a particle size distribution including a weight-average particle size $D_4$ of X μm and Y% by number of toner particles having a particle size of at most 3.17 μm satisfying the following conditions (1) and (2):

$$-5X+35 \leqq Y \leqq -25X+180 \quad (1)$$

$$>4.0 \leqq X \leqq 6.3 \quad (2),$$

(ii) at least one heat absorption peak in a temperature region of at most 110° C. as measured by differential thermal analysis, and (iii) a tap void of 0.45–0.70.

41. The process cartridge according to claim 40, wherein the image-bearing member comprises an electrophotographic photosensitive member.

42. The process cartridge according to claim 40, wherein a layer of the toner is formed on the toner-carrying member by a toner layer thickness-regulating member.

43. The process cartridge according to claim 42, wherein the toner layer thickness-regulating member comprises an elastic blade abutted to the toner-carrying member.

44. The process cartridge according to claim 43, wherein the elastic blade is formed of a member selected from the group consisting of elastomers, elastic synthetic resins, elastic metals and composites of these materials.

45. The process cartridge according to claim 40, wherein the toner-carrying member comprises an electroconductive sleeve, and a resin coating layer containing electroconductive particles and formed on the electroconductive sleeve.

46. The process cartridge according to claim 40, wherein the toner is carried on the toner-carrying member in a layer having a thickness which is smaller than a gap formed between the image-bearing member and the toner-carrying member.

47. The process cartridge according to claim 40, wherein the toner-carrying member comprises a sleeve containing a magnet.

48. The process cartridge according to claim 40, wherein the image-bearing member comprises an electrophotographic photosensitive member, and the cartridge further including at least one of charging means and cleaning means integrated together with the electrophotographic photosensitive member and the developing means to form the cartridge.

49. The process cartridge according to claim 40, wherein the toner is a toner according to any one of claims 2 or 3–23.

* * * * *

UNITED STATES PATENT AND TRADEMARK OFFICE

CERTIFICATE OF CORRECTION

PATENT NO. : 5,712,070

DATED : January 27, 1998

INVENTOR(S) : KEITA NOZAWA ET AL.

It is certified that error appears in the above-identified patent and that said Letters Patent is hereby corrected as shown below:

COLUMN 7

Line 21, "density" should read --density.--.
Line 66, "as" should read --as to--.

COLUMN 9

Line 51, "avid" should read --acid--.

COLUMN 13

Line 14, "fie" should read --fine--.

COLUMN 15

Line 28, "those" should read --the--.

COLUMN 21

Line 63, "(≥2.52 μm)" should read --(≤2.52 μm)--.

COLUMN 31

Line 24, ">4.0≤X≤6.3" should read --4.0≤Y≤6.3--.
Line 37, "(5)," should read --(5):--.

COLUMN 32

Line 56, ">4.0≤X≤6.3" should read --4.0≤Y≤6.3--.

UNITED STATES PATENT AND TRADEMARK OFFICE

CERTIFICATE OF CORRECTION

PATENT NO. : 5,712,070

DATED : January 27, 1998

INVENTOR(S) : KEITA NOZAWA ET AL.

It is certified that error appears in the above-identified patent and that said Letters Patent is hereby corrected as shown below:

COLUMN 33

Line 20, "4-24." should read --3-23.--
Line 37, ">4.0≤X≤6.3" should read --4.0≤Y≤6.3--.

COLUMN 34

Line 22, ">4.0≤X≤6.3" should read --4.0≤Y≤6.3--.

Signed and Sealed this

Eleventh Day of August 1998

Bruce Lehman

*Attest:*

BRUCE LEHMAN

*Attesting Officer*

*Commissioner of Patents and Trademarks*